US012575626B2

(12) United States Patent
Reese et al.

(10) Patent No.: US 12,575,626 B2
(45) Date of Patent: Mar. 17, 2026

(54) APPAREL FASTENER HAVING INTEGRATED ADJUSTABLE TENSIONER

(71) Applicant: OPO TECHNOLOGY LLC, Colorado Springs, CO (US)

(72) Inventors: Robert R. Reese, Colorado Springs, CO (US); Mark Soderberg, Conifer, CO (US); Weyman Weems, Littleton, CO (US)

( * ) Notice: Subject to any disclaimer, the term of this patent is extended or adjusted under 35 U.S.C. 154(b) by 0 days.

(21) Appl. No.: 18/196,624

(22) Filed: May 12, 2023

(65) Prior Publication Data

US 2024/0306748 A1 Sep. 19, 2024

Related U.S. Application Data

(63) Continuation-in-part of application No. 18/122,100, filed on Mar. 15, 2023.

(51) Int. Cl.
*A41F 1/00* (2006.01)
*A41F 9/02* (2006.01)

(52) U.S. Cl.
CPC ..... *A41F 1/008* (2013.01); *A41F 9/025* (2013.01); *Y10T 24/2187* (2015.01)

(58) Field of Classification Search
CPC ... A44B 1/18; A41F 1/008; A41F 9/02; A41F 9/025; Y10T 74/1967; Y10T 24/2187; Y10T 24/1928; Y10T 24/3604; Y10T 24/45042; F16G 11/046
USPC ..... 2/418, 235, 237, 265
See application file for complete search history.

(56) References Cited

U.S. PATENT DOCUMENTS

| | | | | |
|---|---|---|---|---|
| 1,475,065 | A * | 11/1923 | Gilbertson | B60C 27/10 24/68 TT |
| 3,047,876 | A * | 8/1962 | Malcom, Jr. | A42B 3/145 2/9 |
| 3,214,809 | A * | 11/1965 | Zahnor | A61F 9/06 2/418 |
| 3,325,824 | A * | 6/1967 | Donegan | A61F 9/06 24/68 B |
| 4,090,691 | A * | 5/1978 | Bingaman | F16G 11/12 24/71.1 |
| 5,357,654 | A * | 10/1994 | Hsing-Chi | A63B 33/002 2/418 |
| 6,179,176 | B1 * | 1/2001 | Saggese | A45F 3/04 190/18 R |
| 6,708,376 | B1 * | 3/2004 | Landry | A42B 3/145 2/418 |
| 7,000,262 | B2 * | 2/2006 | Bielefeld | A42B 3/145 2/418 |
| 7,222,374 | B2 * | 5/2007 | Musal | A42B 3/066 24/274 WB |
| 7,707,695 | B2 * | 5/2010 | Dubois | A42B 3/145 2/418 |
| 8,424,168 | B2 | 4/2013 | Soderberg et al. | |
| 8,468,657 | B2 | 6/2013 | Soderberg et al. | |
| 8,516,662 | B2 | 8/2013 | Soderberg et al. | |
| 2009/0056487 | A1 * | 3/2009 | Chiu | F16B 2/08 74/422 |

(Continued)

*Primary Examiner* — Jason W San
*Assistant Examiner* — Rowland Do
(74) *Attorney, Agent, or Firm* — GottardoLaw LLC

(57) ABSTRACT

An apparatus and method for fastening apparel with a fastener having an integrated and adjustable tensioner that facilitates a precise fitment of the apparel when worn.

18 Claims, 19 Drawing Sheets

(56) References Cited

U.S. PATENT DOCUMENTS

| | | | | |
|---|---|---|---|---|
| 2009/0211385 | A1* | 8/2009 | Fiquepron | A42B 3/145 74/422 |
| 2010/0170068 | A1* | 7/2010 | Musal | A42B 3/145 24/68 D |
| 2018/0263322 | A1* | 9/2018 | Martin | A41D 1/06 |
| 2020/0093227 | A1* | 3/2020 | Martin | A41F 9/025 |

* cited by examiner

APPAREL FASTENER HAVING INTEGRATED ADJUSTABLE TENSIONER

CROSS REFERENCE TO RELATED APPLICATIONS

This application is a continuation-in-part of and claims the filing date of U.S. Non-provisional patent application Ser. No. 18/122,100 filed on Mar. 15, 2023, which is fully incorporated herein.

TECHNICAL FIELD OF THE INVENTION

This invention relates generally to apparel fastening devices. More specifically, the invention relates to an apparatus and method for fastening apparel with a fastener having an integrated and adjustable tensioner that facilitates a precise fitment of the apparel when worn.

BACKGROUND OF THE INVENTION

Apparel is worn everyday by billions of individuals across the globe. However, despite great variations existing in anatomical size and proportion between these countless individuals, apparel designers and manufacturers, in the interests of cost savings and efficiency, design and produce clothing having only standardized size dimensions; often resulting in the apparel not providing a custom fit for a given individual. For example, the majority of bottoms (i.e., pants, shorts, skirts, etc.) within the marketplace are manufactured having waist sizes falling on 2 inch increments (i.e., 32, 34, 36 in., etc) ill-defined to fit individuals having a waist size not falling on such an increment.

Thus, if a given individual has a 33 inch waistline, that individual is generally both forced to buy a bottom having a waist size falling on the next largest increment, namely, falling on the 34 inch dimension, and thereafter adjust the waist size downwardly by 1 inch via the use of a belt or employment of a tailor. However, numerous disadvantages exist in having to use a belt or employ a tailor to attain a custom fit. Belts present an added cost in having to purchase an accessory in addition to the apparel itself. Also, apparel, for aesthetic reasons, is often designed to not accommodate the use of a belt, i.e., designed to omit belt loops as unsightly or unfashionable. Furthermore, common belts are themselves designed to provide an incremental fitment, i.e., with belt holes falling at incremental locations that may not coincide with the precise measurement of the wearer's waist. Although tailors can indeed alter apparel to custom fit a wearer, the underlying alteration often results in both a destructive and irreversible modification of the apparel itself, further inconveniently requiring a wearer to visit the tailor and undergo physical measurement. The employment of a tailor is often costly as well.

The lack of a custom fit of apparel for a wearer is exacerbated for children undergoing growth spurts. Parents must therefore contend with buying apparel for children who will likely outgrow it over short time durations. Again, because such apparel is not adjustable to custom-fit children during periods of growth, parents often buy oversized clothing that children "can grow into," thus again resulting in a ill-fit between the apparel and wearer.

The lack of a custom fit is also exacerbated by certain apparel designs driven by fashion trends. For example, the rising popularity of low-rise waistbands for bottoms, generally worn below the hips, presents challenges in maintaining such bottoms in the desired position on the wearer.

Simply put, if the bottom has a waist dimension increment larger than that the waistline dimension of the wearer, the bottoms will fall down unless the wearer utilizes bottoms that are uncomfortably too small (i.e., having an waist dimension increment smaller than the wearer's waistline dimension) or uses the aforementioned and often undesirable belt. Also, the average person undergoes weight fluctuations that can result in changes in the waist dimensions of 1 to 2 inches during a given year. Fixed garment sizes do not accommodate for such fluctuations.

Although apparel designers have utilized "stretch fabrication materials" (i.e., elastomeric materials) within apparel in an attempt to provide custom-fit waistlines for the wearer, such materials are prone to degradation over time, i.e., via a laundering or dry cleaning of the apparel, and thus lose their desired elastic capabilities. Elastomeric materials are also prone to fluctuations in their functional abilities due to surrounding temperatures, with warm temperatures often resulting in an expansion of the materials and an associated loss of desired retraction capability. Also, while stretch fabrications provide enhanced comfort, they are designed to expand with the wearer, but not contract; causing a loose fitting garment. Furthermore, the weight of individuals fluctuates daily, and stretch fabrics simply do not contract to allow for these fluctuations.

Although a pair of hip adjusters 1 (i.e., one at each hip) have been utilized in the prior art to tension the waist band of apparel, these adjusters have proved to be problematic. The prior art hip adjusters generally comprise two lengths of strap material 2 and 3, each having a first end of the strap affixed to the apparel, with each second end adjustably attached to one another via a ladder-lock buckle 4. Please see FIG. 1. The ladder-lock buckle 4 is permanently affixed to the end of the first length 2 of strap material while the buckle is adjustably attached to an end of the second length 3 of the strap material.

The adjustable attachment of the ladder-lock buckle 4 to the end of the second length 3 of strap material comprises the strap end fed into the buckle in a "S configuration" such that the buckle binds with the second strap's end until the buckle is positioned about perpendicular to that strap to release the binding grip of the buckle against the strap end. With such ladder-lock buckles 4, however, disadvantages inherently exist wherein the "S configuration" of the second strap end 3 slips through the buckle and thus compromises its binding capability. Also, the structure of each ladder-buckle 4 and is accessible only outside of the waist-line of the apparel, thus making the pair of hip strap adjusters 1 visible and unsightly in those garments where aesthetic style is of issue. Furthermore, the straps and buckles of the hip strap adjusters tend to "ride-up" or become displaced upwardly above the waist line of the apparel, thus resulting in an ill fit. Moreover, these same straps and buckles tend to interfere with any below worn around the waist line.

Thus, what is needed is an apparatus and method for fastening apparel such that apparel designed and manufactured having standardized size dimensions will nonetheless custom-fit the wearer without the need for belts or a tailor. The invention should further accommodate the custom-fit adjustment of children undergoing growth changes, as well as of apparel having design requirements dictated by fashion trends. The invention should also obviate the functional deficiencies associated with prior art, elastomeric materials. The invention should also eliminate the unsightly, interfering and ill fitting use of ladder-buckles and straps associated with hip adjusters. The present invention satisfies these foregoing disadvantages and presents other advantages over the prior art as well.

SUMMARY OF THE INVENTION

This invention relates generally to apparel fastening devices. More specifically, the invention relates to an apparatus and method for fastening apparel with a fastener having an integrated and adjustable tensioner that facilitates a precise fitment of the apparel when worn. In a first embodiment, fastener for apparel comprises a housing defining at least one guide-way, at least one rack connectible with the apparel and translationally associated with the at least one guide-way, with the rack defining a linear arrangement of teeth, as well as a distal end connectable with the apparel. A pinion assembly defines a circular arrangement of teeth configured for operable engagement with the linear arrangement of teeth of the rack. The circular arrangement of teeth is operably biased to a locked position from a rotatable position, with the pinion assembly further defining an outer end configured for insertional engagement with an orifice defined in the apparel.

The pinion assembly further defines a shaft affixed to the housing and terminating outwardly of the housing at the outer end of the assembly, with the circular arrangement of teeth extending radially from a disc having an axial bore defined there-through. The shaft extends through the axial bore of the disc, with the disc rotatable about the shaft and laterally biased to non-rotatably engage the outer end of the assembly to define the locked position. The non-rotatable engagement of the disc to the outer end comprises a mating obstruction defined there-between and the bias of the disc to the non-rotatable engagement comprises a spring forcibly contacting the disc.

A grip is located between the disc and outer end and defining the mating obstruction there-between, with the grip configured to transmit a lateral force to the disc to overcome the bias of the spring and also configured to transmit a rotational force to the disc to rotate the disc when not in the locked position. The grip is further configured for insertional engagement with the orifice. The spring comprises a plurality of inwardly directed tabs defined in the housing about the shaft, the tabs configured for resilient engagement with an inner face of the disc.

In a second embodiment, fastener for apparel comprises a housing defining at least one guide-way, at least one rack connectible with the apparel and translationally associated with the at least one guide-way, with the rack defining a linear arrangement of teeth, as well as a distal end connectable with the apparel. A pinion assembly defines a circular arrangement of teeth configured for operable engagement with the linear arrangement of teeth of the rack. The circular arrangement of teeth is operably biased to a locked position from a rotatable position, with the pinion assembly further defining an outer end configured for insertional engagement with an orifice defined in the apparel.

The pinion assembly further defines a shaft affixed to the housing and terminating outwardly of the housing at the outer end of the assembly, with the circular arrangement of teeth extending radially from a pedestal having an axial bore defined there-through. The shaft extends through the axial bore of the pedestal, with the pedestal rotatable about the shaft and laterally biased to non-rotatably engage the outer end of the assembly to define the locked position.

The non-rotatable engagement of the pedestal to the outer end comprises a mating obstruction defined there-between and the bias of the pedestal to the non-rotatable engagement comprises a spring forcibly contacting the pedestal. A grip is defined on the pedestal proximal to the outer end and defines the mating obstruction there-between. The grip is configured to transmit a lateral force to the pedestal to overcome the bias of the spring, and is also configured to transmit a rotational force to the pedestal to rotate the pedestal when not in the locked position, the pedestal further configured for insertional engagement with the orifice. The spring comprises a coil or circular leaf spring located about the shaft between the pedestal and the housing.

In a third embodiment, the fastener comprises a housing defining at least one guide-way and at least one flexible tensioning member connectible with the apparel and operably associated with the at least one guide-way. The flexible tensioning member defines an epicentric arrangement of male striations. A pinion assembly defining a peripheral arrangement of female striations is configured for operable engagement with the epicentric arrangement of male striations of the flexible tensioning member. The peripheral arrangement of female striations is operably biased to a locked position from a rotatable position, with the pinion assembly further defining an outer end configured for insertional engagement with an orifice defined in the apparel.

The pinion assembly further defines a shaft affixed to the housing and terminating outwardly of the housing at the outer end of the assembly. The peripheral arrangement of female striations is defined within a sheave defined at an inner end of a pedestal and having an axial bore defined there-through, with the shaft extending through the axial bore of the pedestal and sheave. The pedestal and sheave are rotatable about the shaft and laterally biased to non-rotatably engage the outer end of the assembly to define the locked position.

The non-rotatable engagement of the pedestal and sheave to the outer end comprises a mating obstruction defined there-between and the bias of the pedestal and sheave to the non-rotatable engagement comprises a spring forcibly contacting the sheave. A grip is defined on the pedestal proximal to the outer end and defines the mating obstruction there-between. The grip is configured to transmit a lateral force to the pedestal and sheave to overcome the bias of the spring, and is also configured to transmit a rotational force to the pedestal and sheave to rotate the pedestal and sheave when not in the locked position. The grip is further configured for insertional engagement with the orifice.

The fastener optionally further comprises a link operably engaged with the primary end of the flexible tensioning member and connectable with the apparel. Tensioning webbing defines first and second ends, with the first end extending through an orifice defined on the link and the second end connectable with the apparel.

DESCRIPTION OF THE EMBODIMENTS

Figure 1:
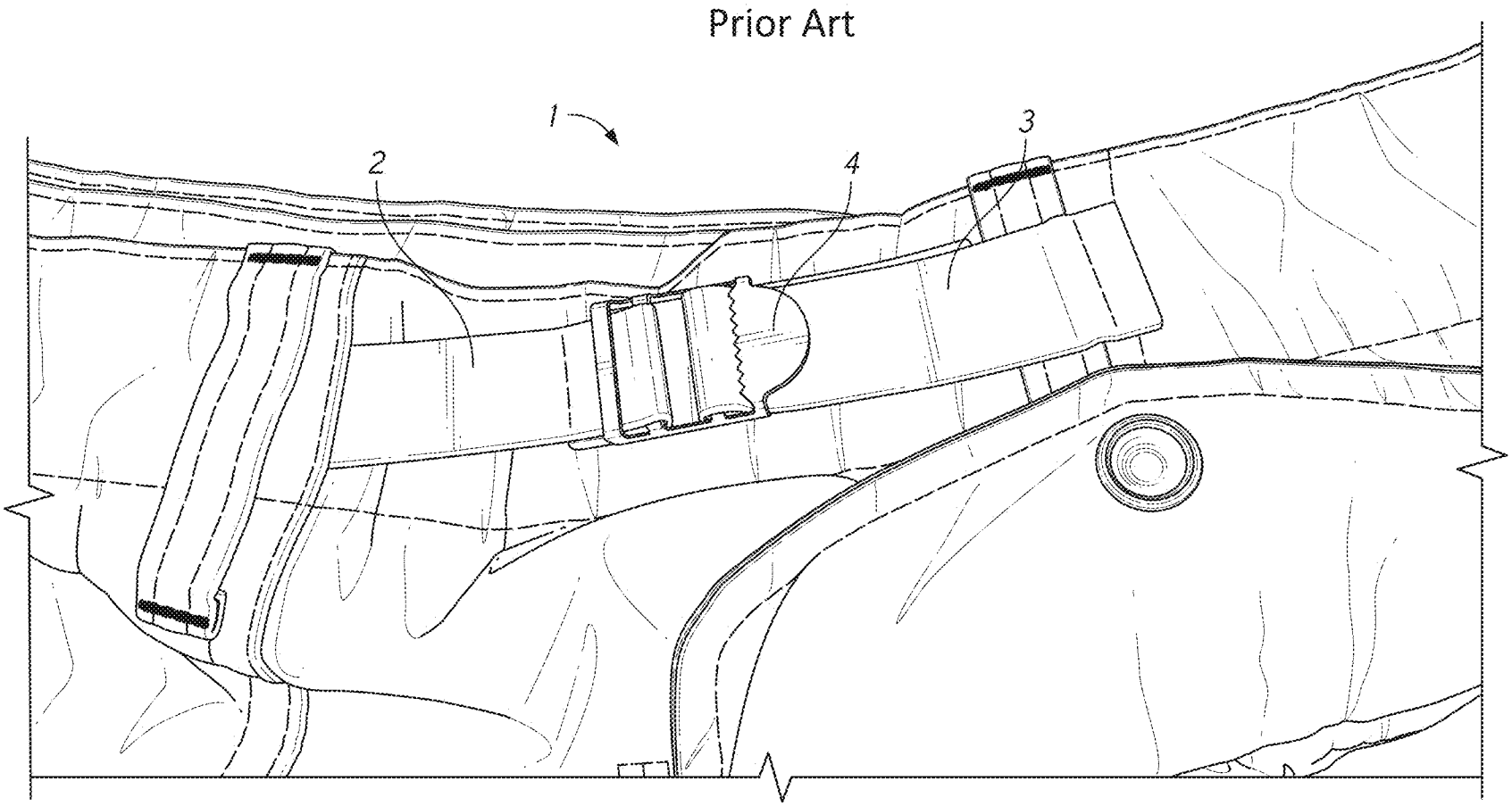
FIG. 1 is a plan view of a prior art ladder-buckle hip adjuster for apparel.
Figure 2:
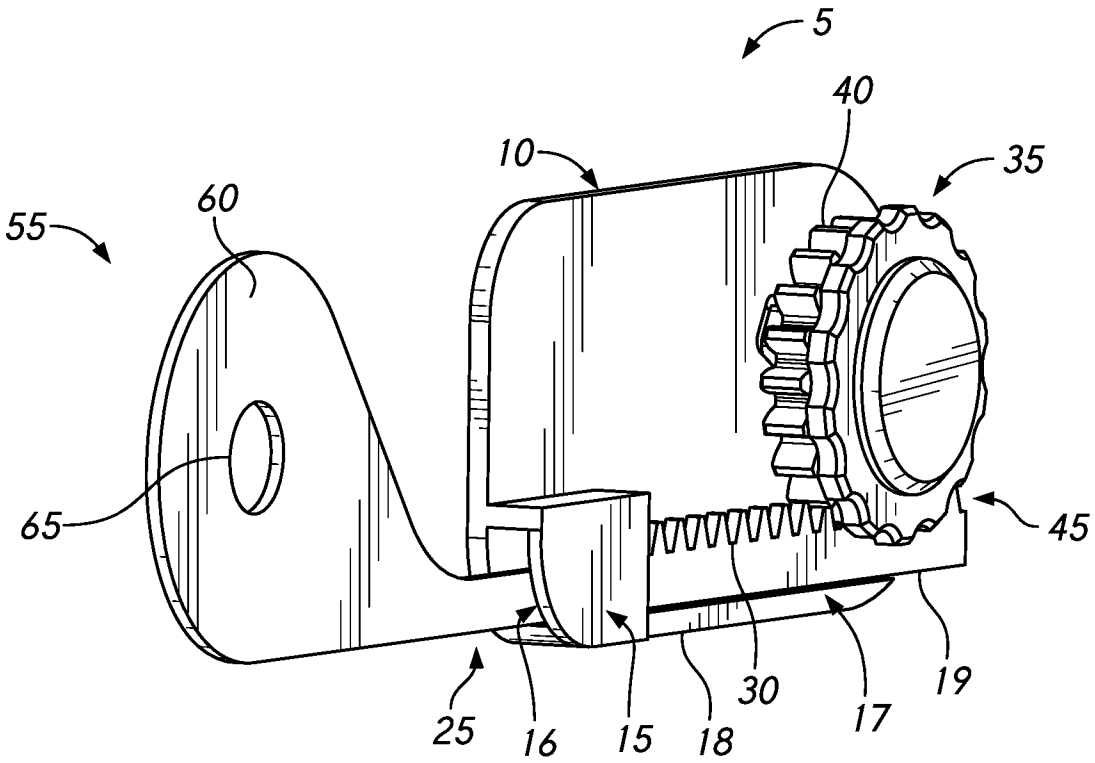
FIG. 2 is a perspective view of a first embodiment of the fastener.

This invention relates generally to apparel fastening devices. More specifically, the invention relates to an apparatus and method for fastening apparel with a fastener having an integrated and adjustable tensioner that facilitates a precise fitment of the apparel when worn. In a first embodiment illustrated in FIGS. 2, 3 and 4, the fastener 5 comprises a planar housing 10 defining at least one guide-way 15. The planar housing 10 is sheet-like in structure to allow for a non-interfering and operable relation of the fastener 5 with the sheet-form material typically comprising apparel 20. At least one rack 25 is connectible with the apparel 20 and translationally associated with the at least one guide-way 15, with the at least one rack defining a linear arrangement of teeth 30. The guide-way preferably comprises at least one slot 16 defined in the housing 10 and a shelf 17 defined along the housing's bottom edge 18. The shelf 17 is configured to support the at least one 25 rack along its bottom surface 19 while the at least slot 16 is configured to both accept a male insertion of the rack there-through and maintain the rack on the shelf.

A pinion assembly 35 defining a circular arrangement of teeth 40 is configured for meshing engagement with the linear arrangement of teeth 30 of the at least one rack 25. The circular arrangement of teeth 40 is operably biased to a locked position "A" from a rotatable position "B" (FIG. 4), such that the rack 25 is prevented from translating in relation to the housing 10 when the circular arrangement of teeth are in the locked position and allowed to translate when the circular arrangement of teeth is in the rotatable position. The pinion assembly 35 further defines an outer end 45 configured for insertional engagement with an orifice 50, also conventionally known as a button hole, (FIG. 3) defined in the apparel 20.

A distal end 55 of the at least one rack 25 is configured for fixable engagement with the material of the apparel 20. In the embodiment illustrated in FIGS. 2 and 3, the distal end 55 of the at least one rack 25 defines a planar flange 60 having a void 65 defined there-through. The planar flange 60 is sheet-like in structure to allow for a non-interfering and operable relation of the rack 25 with the sheet-form material typically comprising apparel 20. In this embodiment, the void 65 defines a through bore such that a rivet or similar fastener (not shown) may be inserted through the rack's void 65 and adjacent material of the apparel 20 to securely fasten the rack to the apparel. In other embodiments, however, the flange 60 of the at least one rack 25 may be sewn to adjacent material of the apparel 20 as well.

Figure 3:
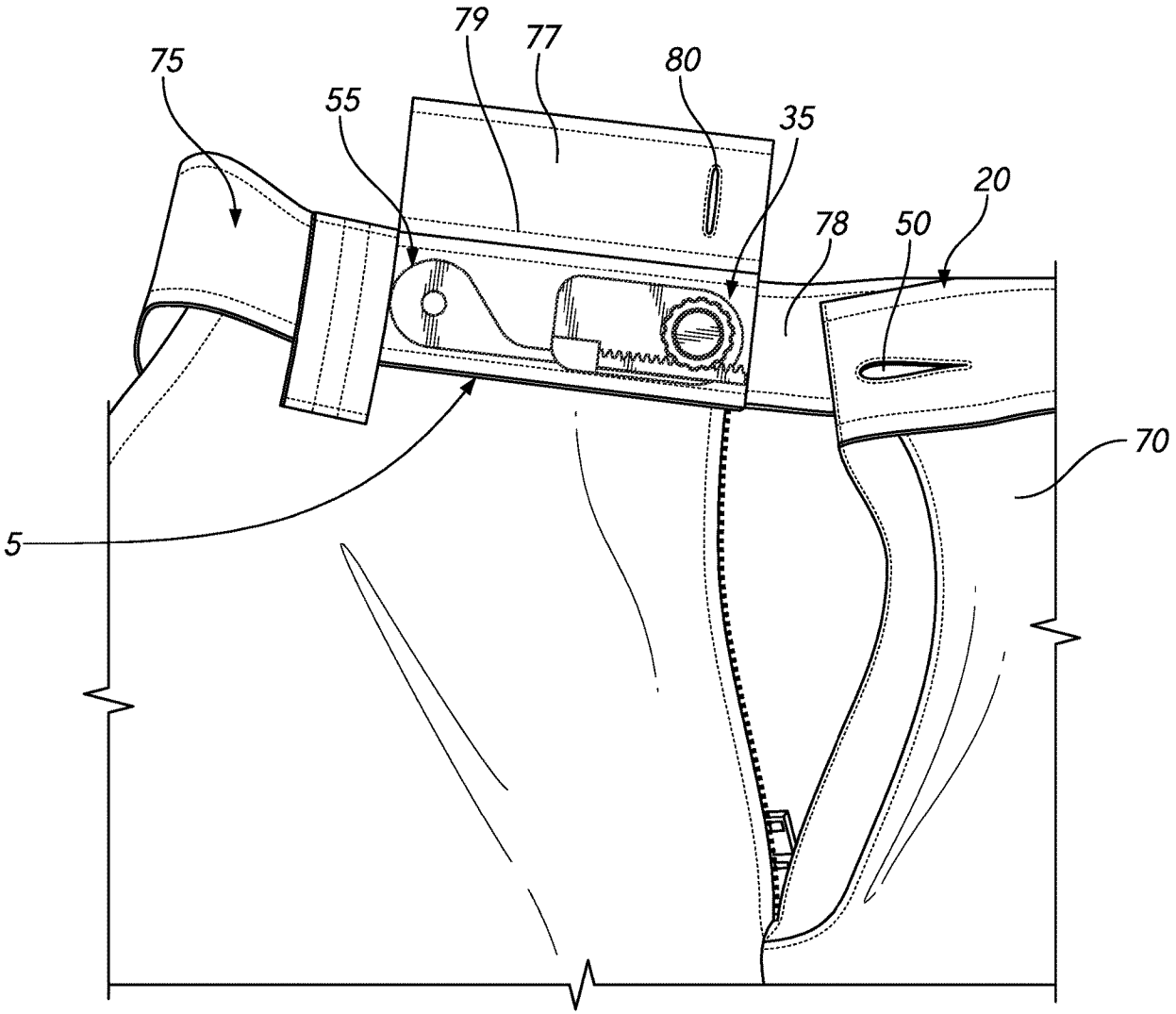
FIG. 3 is a view of the fastener of FIG. 2 utilized with apparel.

As illustrated in FIG. 3, the apparel 20, for example, comprises a pair of pants 70, with the fastener 5 incorporated into the pants' waistline 75 to replace a standard button (not shown). As is typical within the industry, the pants 70 includes a hollow loop of material at its waistline to create at least two "front-to-back" layers 77 and 78 of material encircling the waistline to increase its strength and durability. To more clearly illustrate the placement of the fastener 5 in relation to the pants 70, FIG. 3 illustrates a rectangular section of the front material 77 lifted upwardly and away from the rear material 78 along a seam 79 such that the apparatus is proximal to the rear material and the front material is folded downwardly along the seam to a location proximal to and in front of the apparatus. The fastener's housing 10, at least one guide-way 15, at least one rack 25 and tensioning webbing 81 are together preferably located within the hollow loop of material of the pant's waistline 75, i.e., preferably between the front and back material layers 77 and 78, with the fastener's pinion assembly 35 protruding outwardly through an opening 80, defined through the front layer, to function as the standard button for insertion through the apparel's orifice 50.

In a preferred embodiment, the housing 10 and the second end 83 of the tensioning webbing 81 are sewn to either or both the back and/or front material layers 77 of the apparel 20. The tensioning webbing 81 may define a length between its first and second ends 82 and 83 (within the loop of material of the pant's waistline) of any length less than or equal to the waistline's length itself such that the webbing may extend any distance from the at least one rack 25 up to the orifice 50 of the pants, with the webbing preferably comprised of non-stretchable material that does not expand along its length while under tension. The 80 webbing material is tensioned between the end of the rack 425 and a location along the waistline of the apparel to freely be able to tension between the inner and outer material layers. As the webbing is tensioned, the waistline between the fastener and the anchored second end 83 of the webbing 81 is compressed and buckles or accordions to accommodate the shortening and shrinking of the waistline size. This webbing band may essentially extend the full circumference of the pant or be any amount shorter desired.

In many pants and waistlines, elastic textiles are used incorporating elastic threads (Spandex, Lycra) to provide some accommodation of a person's waist dimension. By varying the length of a non-stretch webbing or other fabric strip, the elasticity can be varied. It can also be varied by incorporating sections of elastic materials into the webbing element such as a urethane sheet material of various durometers or incorporating elasticity in the webbing material itself.

The fastener's housing 10, at least one guide-way 15 and at least one rack 25 are together sewn into the pant's waistline 75, preferably between the front and back material layers 77 and 78, with the fastener's pinion assembly 35 protruding outwardly through an opening 80, defined through the front layer, to function as the standard button for insertion through the apparel's orifice 50. The fastener's housing 10 may also be anchored to its location to keep the button in the right position when tensioned in any number of ways, i.e., riveted to the inner waistband layer, stitched or tacked at one end or both, or blocked from movement by stitched or bar tacking at the tensioned end or both ends.

The rack 25 and housing 10 are preferably comprised of flexible, lightweight, and corrosion-free sheet-form materials of high durability. The flexible and lightweight traits of the material allow the components to assume the bodily contours of a wearer of the apparel utilizing the fastener, all while adding negligible weight to the apparel itself. The material of the rack and/or housing may be produced or manufactured to possess a predetermined curvature to further ensure a proper of the apparatus to the contours of a body. The durable and corrosion free traits of the material allows for the regular wear and laundering of the apparel utilizing the fastener without risk of the fastener staining the apparel or otherwise breaking. As such, at least the housing and rack preferably comprise sheet-form plastic or aluminum. Typical plastic materials could be Nylon 6/6, Polycarbonate, Acetal, or Polyester. The thickness of the sheet-form material comprising the housing 10 is between about 0.039 and 0.393 inches, preferably between about 0.079 and 0.197 inches, and optimally about 0.177 inches. Similarly, the thickness of the sheet-form material comprising the rack 25 is between about 0.016 and 0.393 inches, preferably between about 0.023 and 0.197 inches, and optimally about 0.393 inches. The sheet-form materials for the housing 10 and/or rack 25 may be stamped from a sheet-form material source, made from an injection molded process, machined or manufactured by other means understood in the art.

Figure 4:
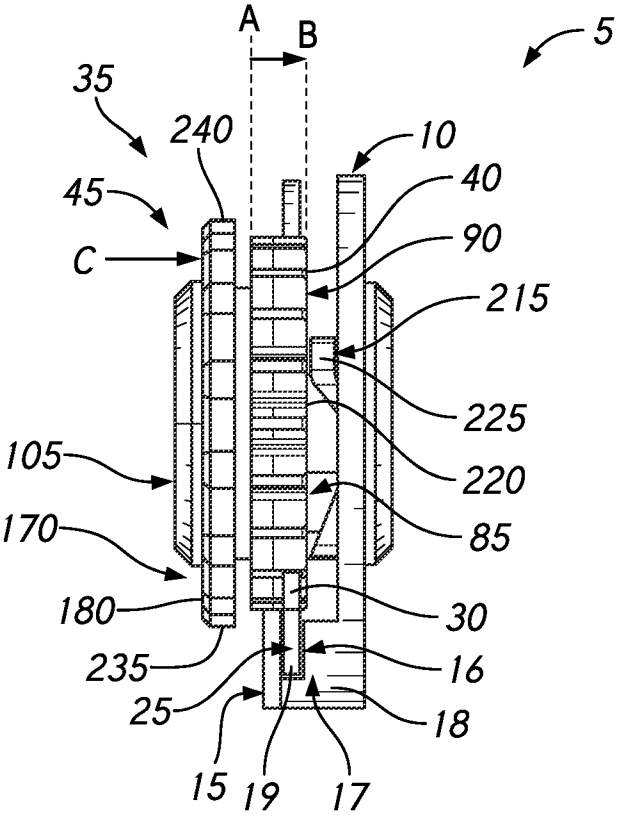
FIG. 4 is an elevation view of a proximal end of the fastener of FIG. 2.
Figure 5:
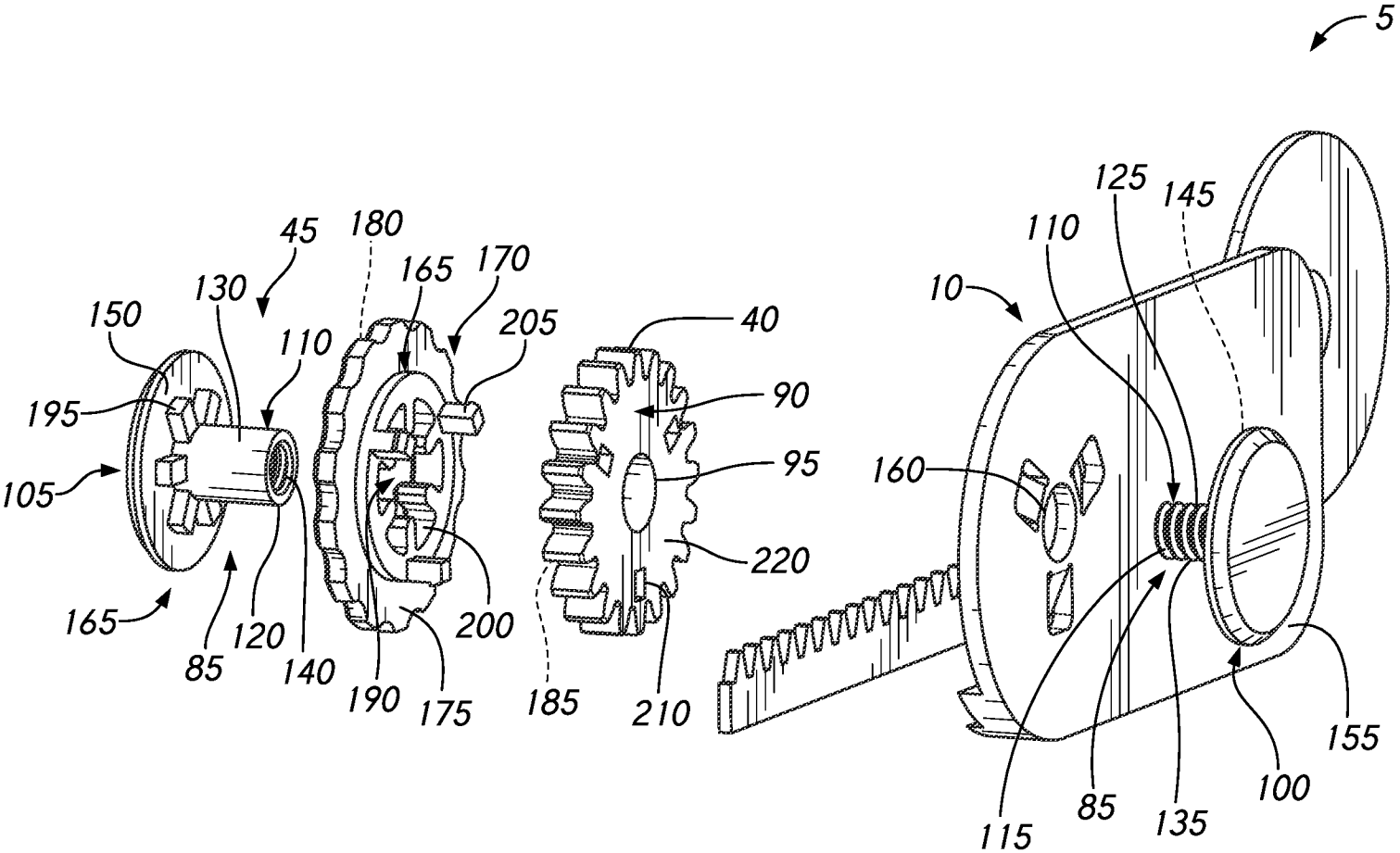
FIG. 5 is an exploded view of the fastener of FIG. 2 illustrating the details of a mating engagement within the pinion assembly.

Referring now to FIGS. 4 and 5, the pinion assembly 35 further defines a shaft 85 affixed to the housing 10 and terminating outwardly of the housing at the pinion assembly's outer end 45. The circular arrangement of teeth 40 extends radially from a disc 90 having an axial bore 95 defined there-through. The shaft 85 extends through the axial bore 95 of the disc 90, which is configured for both rotational and lateral movement about the shaft 85. The disc 90 is rotatable about the shaft 85 and laterally biased to non-rotatably engage the outer end 45 of the pinion assembly to define the aforementioned locked position "A."

As best illustrated in FIG. 5, the shaft 85 comprises opposing column ends 100 and 105 defined opposite of one another to define a central column 110, with each column end approximating the shape of a rivet head. The opposing column ends 100 and 105, in turn, each define inner mating ends 115 and 120, and associated column portions 125 and 130 which, when in mating relation with one another, define the central column 110. The mating ends 115 and 120 thus preferably define respective, male and female threaded components 135 and 140 that threadedly engage one another to define the column 110. Although a threaded connection is described and illustrated herein at mating ends 115 and 120, it is understood that other connections may be utilized as well, to include pinned male-female connections, press-fit and other connections understood in the art as preventing a rotation and translation of components relative to one another.

Referring again to FIG. 5, the opposing column ends 100 and 105 each define a planar inner face 145 and 150. Planar inner face 145 is affixed to a planar rear surface 155 of the housing 10 such that column portion 125 extends forwardly through a hole 160 defined through the housing for threaded engagement with opposing column portion 130. Such affixation may comprise spot welding, thermal bonding, press fitting, riveting, brazing, adhesive bonding or other bonding methods understood in the art. The affixation of the inner face 145 of the column end 100 to the rear surface 155 of the housing 10 prevents the column end and associated portion 125 from rotating in relation to the housing and also from translating outwardly from the housing's rear surface 155. The threaded engagement of the opposing column portion 125 and end mating end 115 to opposing portion 130 thus similarly affixes them as well in relation to the housing 10.

The non-rotatable engagement of the disc 90 to the outer end 45 of the pinion assembly 35 preferably comprises a mating obstruction 165 defined there-between. More specifically, as illustrated herein, a grip 170 is located between the disc 90 and assembly's outer end 45 that defines the mating obstruction 165. The grip 170 thus defines inner and outer faces 175 and 180, with the grip outer face configured for mating engagement with the inner face 150 of column end 105, and the grip inner face 175 configured for fixable engagement with an outer face 185 of the disc 90. A grip bore 190 is defined between its inner and outer faces 180 and 185 and is configured for both rotational and lateral movement about the shaft 85.

Referring again to FIG. 5, a plurality of radial spokes 195 protrude from the inner face 150 of outer column end 105 for mating engagement with a plurality of radial recesses 200 defined in the grip outer face 180. The mating engagement of the spokes 195 with the recesses 200 prevents the grip 170 from rotating in relation to the outer end 45 of the pinion assembly 35, but nonetheless allows the grip to move laterally and inwardly from the end and along the shaft 85. As further illustrated in FIG. 5, a plurality of projections 205 protrude from the inner face 175 of grip 170 for mating engagement with a plurality of receivers 210 defined in the disc outer face 185. The mating engagement of the projections 205 with the receivers 210 prevents the grip 170 from both rotating in relation to the disc 90 and translating outwardly from the disc and along the shaft 85 as well. The components of the pinion assembly 35, together or independently, may be comprised of durable materials, to include aluminum, steel, plastics, combinations or other materials understood in the art as providing the desired durability. Typical plastic materials could be Nylon 6/6, Polycarbonate, Acetal, or Polyester.

Figure 6:
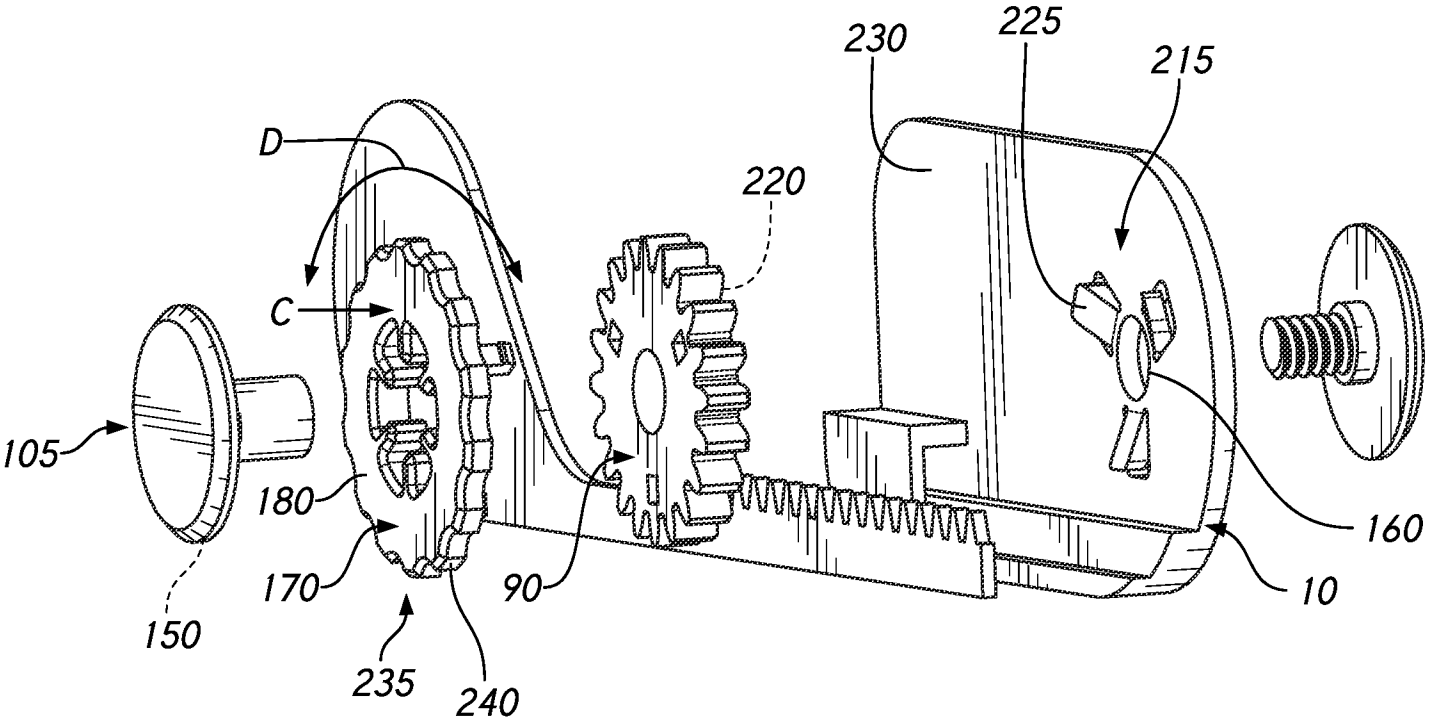
FIG. 6 is an exploded view of the spring of the housing along with the disc and grip of the pinion assembly of FIG. 2.

The lateral bias of the disc 90 and connected grip 170 along the shaft 85 to a non-rotatable engagement with the inner face 150 of the column end 105 comprises a spring 215 that forcibly contacts an inner face 220 of the disc 90. Referring to FIG. 6, in a preferred embodiment, the spring 215 comprises a plurality of forwardly directed tabs 225 defined in the housing 10 about housing's hole 160 and configured for resilient engagement with the inner face 220 of the disc 90. In other embodiments, however, a common coil spring (not shown) or circular leaf spring (FIGS. 10-11) may be located on the shaft 85 between an inner wall 230 of the housing 10 and the inner face 220 of the disc 90 to bias the disc and grip 170 to the non-rotatable engagement with the outer column end 105. It is further understood that the spring 215 may comprise a cantilever spring(s) of metal or plastic or an elastomeric foam spring among others.

Referring again to FIGS. 4 and 6, the grip 170 is thus configured to transmit a lateral force "C" to the disc 90 to both overcome the bias of the spring 215 and move the disc laterally along the shaft 85 of the pinion assembly 35 to the rotatable position "B" from the locked position "A," and also configured to transmit a rotational force "D" to the disc (when not in the locked position), to rotate the disc's circular arrangement of teeth 40 against the rack 25. More specifically, the lateral force "C" urges the disc's inner face 220 against the plurality of forwardly directed tabs 225 of the housing 10 housing such that the tabs are resiliently defected rearwardly towards the housing's inner wall 230.

During this movement, the teeth 40 of the disc 90 remain engaged with the at least one rack 25, but translate rearwardly in relation to the rack's teeth 30 and towards the housing's inner wall 230. During this rearward movement, the disc is translated rearwardly along the column 110 to disengage the disc's recesses 200 from the spokes 195 of the outer column end 105. With the spokes and recesses disengaged from one another, the grip and disc are now together rotatable about the column 110 via the application of rotatable force "D" (FIG. 6). Of course, during any rotation of the disc 90, the rack 25 will translate in relation to the housing 10, and apply a like translational force against the material of the apparel 20 affixed to the rack's planar flange 60.

To facilitate the transmission of both the lateral and rotational forces "C" and "D" to the disc 90, the grip 170 defines a diameter larger than that of both the disc and the column end 105 such that both the outer face 180 of the grip and an associated peripheral edge 235 are exposed beyond that of the column end to a facilitate tactile contact with the fingers and thumb of a user of the fastener 5 and to prevent an accidental application of the lateral force "C" via a pressure applied against the column end (i.e., should one wearing the fastener and apparel receive a pressure against the fastener by leaning the waist line of the apparel against a counter, and/or by tightening a belt around the waist line and against the fastener).

In a preferred embodiment, the peripheral edge 235 of the grip 170 is also textured to improve such tactile contact as well. For example, in the embodiments illustrated herein, the peripheral edge 235 of the grip 170 defines a plurality of truncated ridges 240. However other textures may suffice as well, to include cross-hatch, dimpled and other patterns understood in the art of increasing tactile friction. Nonetheless, despite the larger diameter of the grip 170, the diameter is nonetheless configured for insertional engagement with the standard orifice 50 defined in the apparel 20. Thus, the diameter of the grip is between about 0.375 and 2.0 inches, preferably between about 0.5 and 1.5 inches, and optimally about 0.875 inches.

Figure 7:
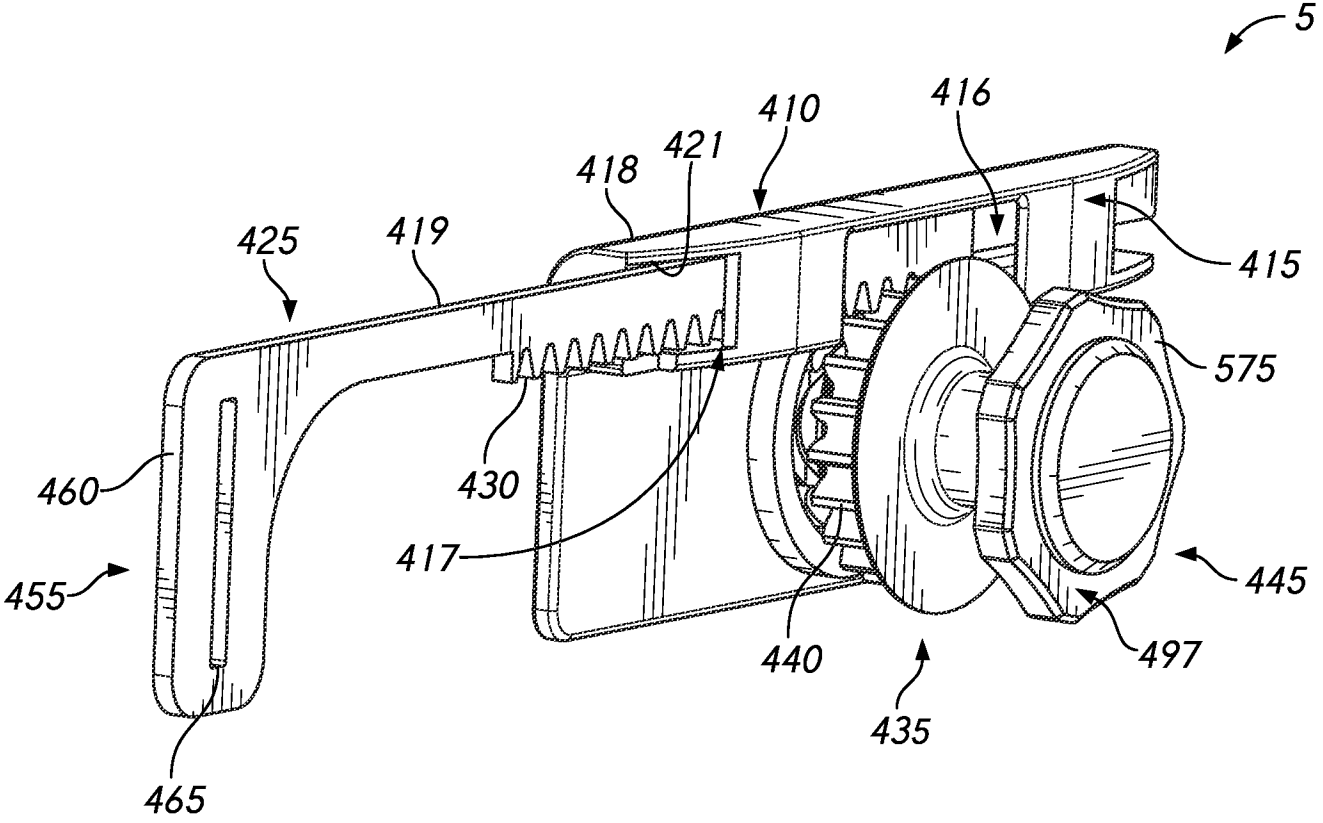
FIG. 7 is a perspective view of a second embodiment of the fastener.
Figure 8:
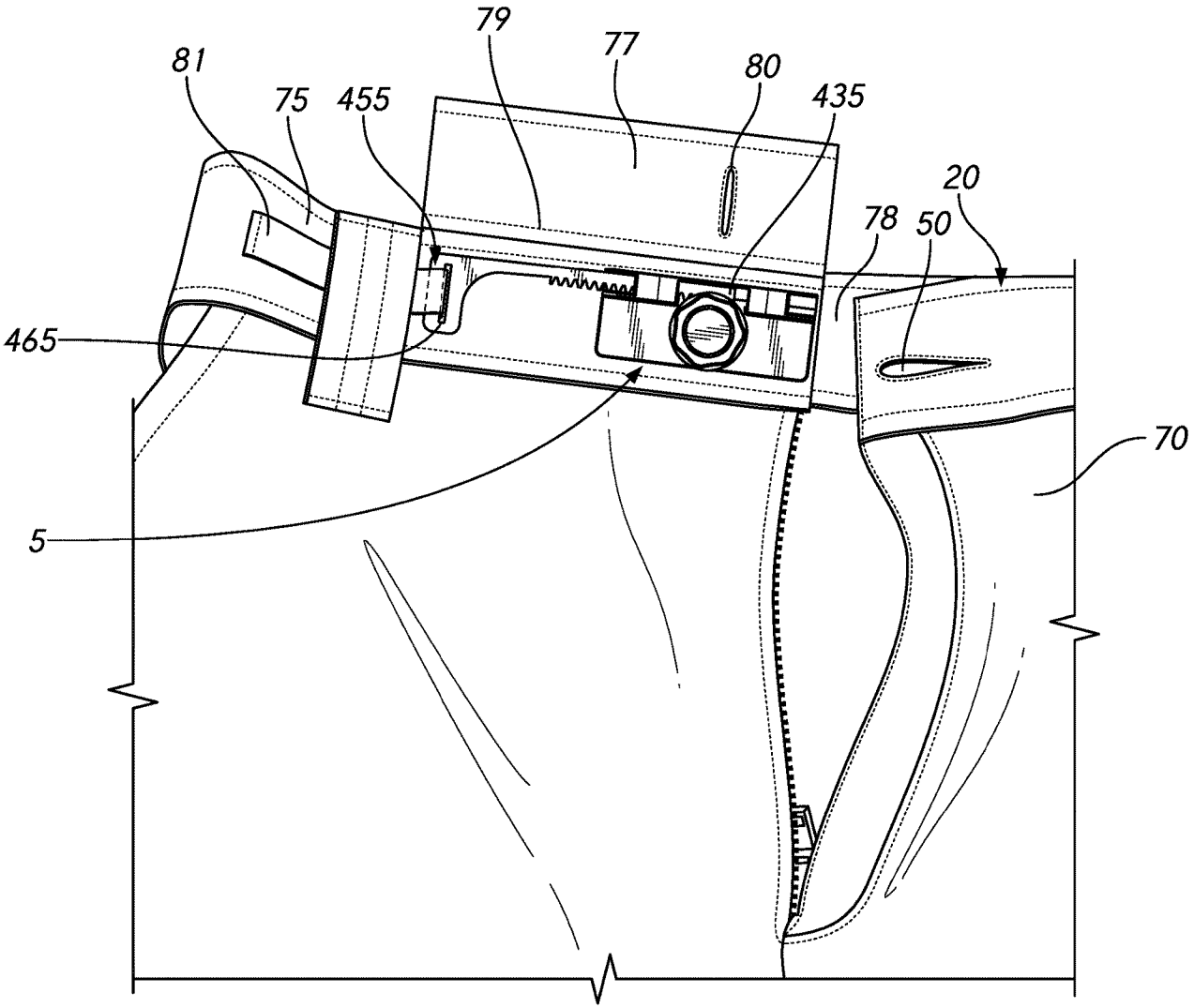
FIG. 8 is a view of the fastener of FIG. 7 utilized with apparel.
Figure 9:
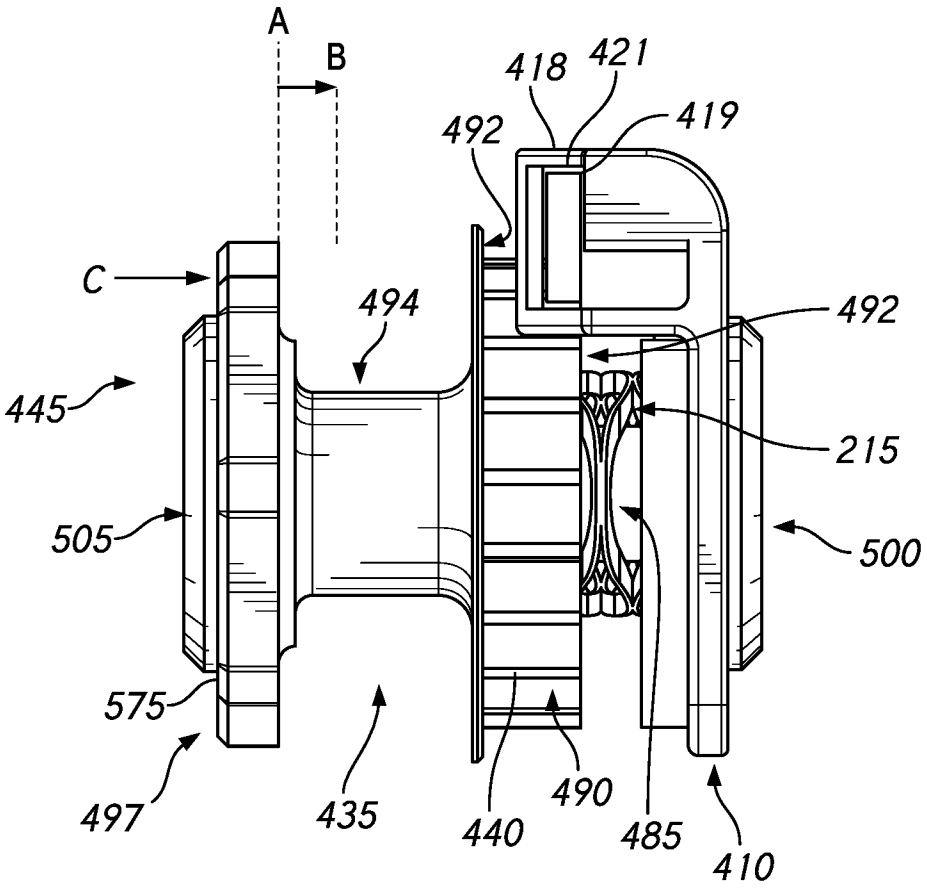
FIG. 9 is an elevation view of a proximal end of the fastener of FIG. 7.

In the second embodiment illustrated in FIGS. 7, 8 and 9, the fastener 5 again comprises a planar housing 410 defining at least one guide-way 415. The planar housing 410 is sheet-like in structure to allow for a non-interfering and operable relation of the fastener 5 with the sheet-form material typically comprising apparel 20. At least one rack 425 is connectible with the apparel 20 and translationally associated with the at least one guide-way 415, with the at least one rack defining a linear arrangement of teeth 430. The guide-way preferably comprises at least one slot 416 defined in the housing 410 and a shelf 417 defined proximal to the housing's top edge 418. An abutment 421 is defined along the housings top edge and is configured to abut the at least one 425 rack along its top surface 419. The at least one slot 416 is configured to both accept a male insertion of the rack there-through and maintain the rack along the shelf 417.

A pinion assembly 435 defining a circular arrangement of teeth 440 is configured for meshing engagement with the linear arrangement of teeth 430 of the at least one rack 425. The circular arrangement of teeth 440 is operably biased to a locked position "A" from a rotatable position "B" (FIG. 9), such that the rack 425 is prevented from translating in relation to the housing 410 when the circular arrangement of teeth are in the locked position and allowed to translate when the circular arrangement of teeth are in the rotatable position. The pinion assembly 435 further defines an outer end 445 configured for insertional engagement with an orifice 50, also conventionally known as a button hole, (FIG. 3) defined in the apparel 20.

A distal end 455 of the at least one rack 425 is configured for fixable engagement with the material of the apparel 20. In the embodiment illustrated in FIGS. 2 and 3, the distal end 455 of the at least one rack 425 defines a planar flange 460 having a void 465 defined there-through. The planar flange 460 is sheet-like in structure to allow for a non-interfering and operable relation of the rack 425 with the sheet-form material typically comprising apparel 20. In this embodiment, the void 465 defines a through rectangular opening such that a portion or flap of the tensioning webbing 81 of the apparel 20 may be inserted through the void and sewn, riveted, or ultrasonically welded to the apparel adjacent thereto. However, a rivet or similar fastener (not shown) may also be inserted through the rack's void 465 and adjacent material of the apparel 20 to securely fasten the rack to the apparel. In other embodiments, however, the flange 460 of the at least one rack 425 may be sewn to adjacent material of the apparel 20 as well.

As illustrated in FIG. 8, the apparel 20, for example, comprises a pair of pants 70, with the fastener 5 incorporated into the pant's waistline 75 to replace a standard button (not shown). As is typical within the industry, the pants 70 includes a hollow loop of material at its waistline to create at least two "front-to-back" layers 77 and 78 of material encircling the waistline to increase its strength and durability. To more clearly illustrate the placement of the fastener 5 in relation to the pants 70, FIG. 8 illustrates a rectangular section of the front material 77 lifted upwardly and away from the rear material 78 along a seam 79 such that the apparatus is proximal to the rear material and the front material is folded downwardly along the seam to a location proximal to and in front of the apparatus. The fastener's housing 410, at least one guide-way 415, at least one rack 425 and tensioning webbing 81 are together preferably located within the hollow loop of material of the pant's waistline 75, i.e., preferably between the front and back material layers 77 and 78, with the fastener's pinion assembly 735 protruding outwardly through an opening 80, defined through the front layer, to function as the standard button for insertion through the apparel's orifice 50.

In a preferred embodiment, the housing 410 and the second end 83 of the tensioning webbing 81 are sewn to either or both the back and/or front material layers 77 of the apparel 20. The tensioning webbing 81 may define a length between its first and second ends 82 and 83 (within the loop of material of the pant's waistline) of any length less than or equal to the waistline's length itself such that the webbing may extend any distance from the rack 425 up to the orifice 50 of the pants, with the webbing preferably comprised of non-stretchable material that does not expand along its length while under tension. The 80 webbing material is tensioned between the end of the rack 425 and a location along the waistline of the apparel to freely be able to tension between the inner and outer material layers. As the webbing is tensioned, the waistline between the fastener and the anchored second end 83 of the webbing 81 is compressed and buckles or accordions to accommodate the shortening and shrinking of the waistline size. This webbing band may essentially extend the full circumference of the pant or be any amount shorter desired.

In many pants and waistlines, elastic textiles are used incorporating elastic threads (Spandex, Lycra) to provide some accommodation of a person's waist dimension. By varying the length of a non-stretch webbing or other fabric strip, the elasticity can be varied. It can also be varied by incorporating sections of elastic materials into the webbing element such as a urethane sheet material of various durometers or incorporating elasticity in the webbing material itself.

The fastener's housing 410, at least one guide-way 415 and at least one rack 425 are together sewn into the pant's waistline 75, preferably between the front and back material layers 77 and 78, with the fastener's pinion assembly 435 protruding outwardly through an opening 80, defined through the front layer, to function as the standard button for insertion through the apparel's orifice 50. The fastener's housing 410 may also be anchored to its location to keep the button in the right position when tensioned in any number of ways, i.e., riveted to the inner waistband layer, stitched or tacked at one end or both, or blocked from movement by stitched or bar tacking at the tensioned end or both ends.

The rack 425 and housing 410 are preferably comprised of flexible, lightweight, and corrosion-free sheet-form materials of high durability. The flexible and lightweight traits of the material allow the components to assume the bodily contours of a wearer of the apparel utilizing the fastener, all while adding negligible weight to the apparel itself. The material of the rack and/or housing may be produced or manufactured to possess a predetermined curvature to further ensure a proper of the apparatus to the contours of a body. The durable and corrosion free traits of the material allows for the regular wear and laundering of the apparel utilizing the fastener without risk of the fastener staining the apparel or otherwise breaking. As such, at least the housing and rack preferably comprise sheet-form plastic or aluminum. Typical plastic materials could be Nylon 6/6, Polycarbonate, Acetal, or Polyester. The thickness of the sheet-form material comprising the housing 10 is between about 0.039 and 0.393 inches, preferably between about 0.079 and 0.197 inches, and optimally about 0.177 inches. Similarly, the thickness of the sheet-form material comprising the rack 25 is between about 0.016 and 0.393 inches, preferably between about 0.023 and 0.197 inches, and optimally about 0.393 inches. The sheet-form materials for the housing 10 and/or rack 25 may be stamped from a sheet-form material source, made from an injection molded process, machined or manufactured by other means understood in the art.

Figure 10:
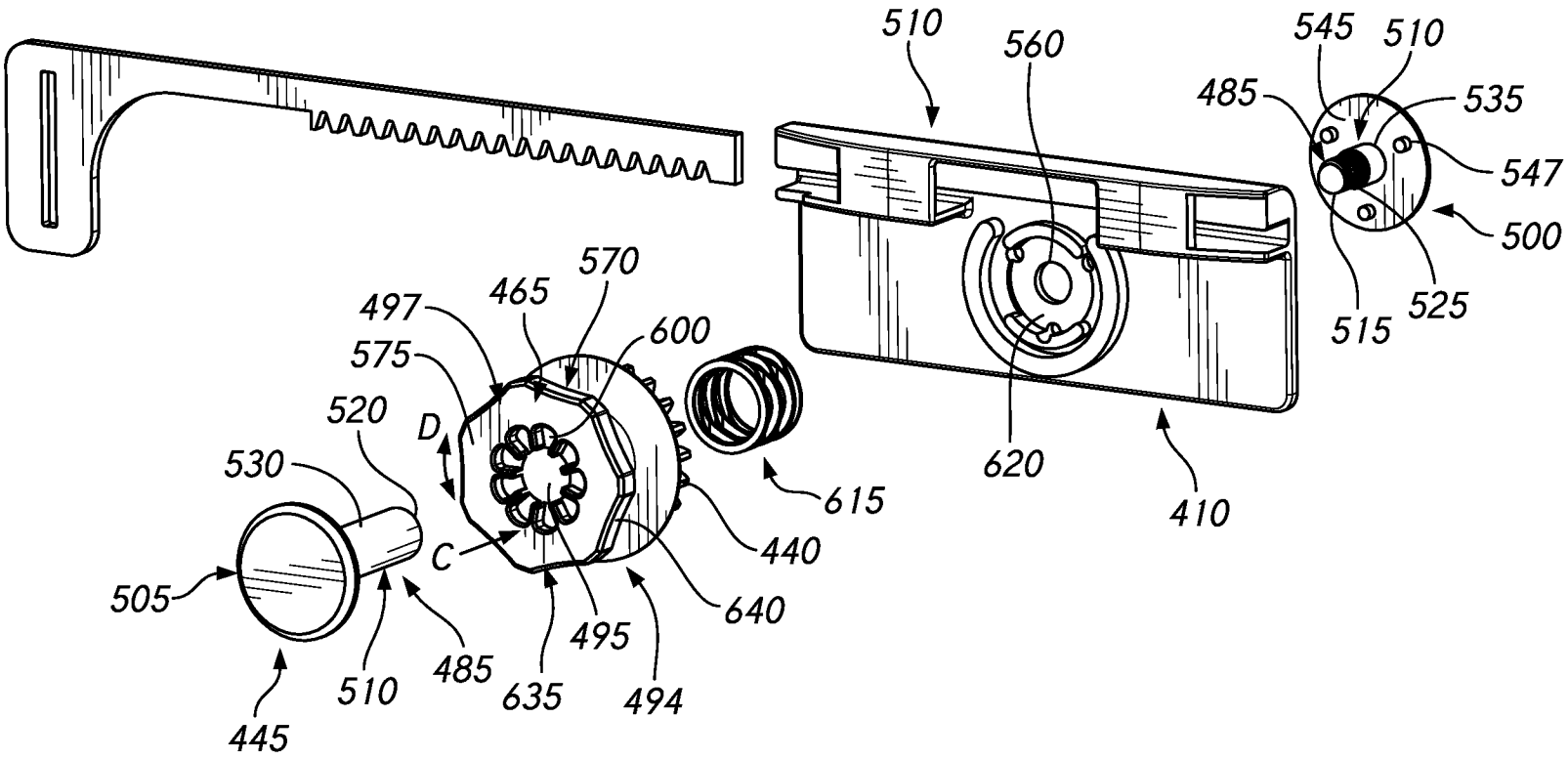
FIG. 10 is an exploded view of the fastener of FIG. 7 illustrating the details of a mating engagement within the pinion assembly.

Referring now to FIGS. 9 and 10, the pinion assembly 435 further defines a shaft 485 affixed to the housing 410 and terminating outwardly of the housing at the pinion assembly's outer end 445. The circular arrangement of teeth 440 extends radially from a disc 490 defined at an inner end 492 of a longitudinal pedestal 494, with the pedestal 494 and disc 490 having an axial bore 495 defined there-through. The shaft 485 extends through the axial bore 495 of the pedestal 494 and disc 490, both of which are configured for both rotational and lateral movement about the shaft 485. The pedestal 494 further defines an outer face 575 at an outer end 497 thereof, each of which has the axial bore 495 defined there-through. The pedestal 494 is rotatable about the shaft 485 and laterally biased outwardly such that its outer end 497 non-rotatably engages the outer end 445 of the pinion assembly to define the aforementioned locked position "A."

As best illustrated in FIG. 10, the shaft 485 comprises opposing column ends 500 and 505 defined opposite of one another to define a central column 510, with each column end approximating the shape of a rivet head. The opposing column ends 500 and 505, in turn, each define inner mating ends 515 and 520, and associated column portions 525 and 530 which, when in mating relation with one another, define the central column 510. The mating ends 515 and 520 thus preferably define respective, male and female threaded components 535 and 540 that threadedly engage one another to define the column 510. Although a threaded connection is described and illustrated herein at mating ends 515 and 520, it is understood that other connections may be utilized as well, to include pinned male-female connections, press-fit and other connections understood in the art as preventing a rotation and translation of components relative to one another.

Referring again to FIG. 10, the opposing column ends 400 and 505 each define a planar inner face 545 and 550. Planar inner face 545 is affixed to a planar rear surface 555 of the housing 510 such that column portion 525 extends forwardly through a hole 560 defined through the housing for threaded engagement with opposing column portion 530. Such affixation may comprise spot welding, thermal bonding, press fitting, riveting, brazing, adhesive bonding or other bonding methods understood in the art. The affixation of the inner face 545 of the column end 500 to the rear surface 555 of the housing 510 prevents the column end and associated portion 525 from rotating in relation to the housing and also from translating outwardly from the housing's rear surface 555. The threaded engagement of the opposing column portion 525 and end mating end 515 to opposing portion 530 thus similarly affixes them as well in relation to the housing 510. At least one pin 547 is defined on the inner face 545 of the inner column end 500 for mating engagement with at least one receiver 549 defined in the housing 510. Thus, if the threaded engagement of the column portions 525 and 530 affixes them to the housing 510, the engagement of the at least one pin 547 with the receiver 549 prevents at least the inner column end 500 from rotating in relation to the housing.

The non-rotatable engagement of the pedestal 494 to the outer end 445 of the pinion assembly 435 preferably comprises a mating obstruction 465 defined there-between. More specifically, as illustrated herein, the pedestal outer face 575 configured for mating engagement with the inner face 150 of column end 105. Referring again to FIG. 10, a plurality of radial spokes 595 protrude from the inner face 550 of outer column end 505 for mating engagement with a plurality of radial recesses 600 defined in the pedestal outer face 575. The mating engagement of the spokes 595 with the recesses 600 prevents the pedestal 494 from rotating in relation to the outer end 445 of the pinion assembly 435, but nonetheless allows the pedestal to move laterally and inwardly from the end and along the shaft 485. The components of the pinion assembly 435, together or independently, may be comprised of durable materials, to include aluminum, steel, plastics, combinations or other materials understood in the art as providing the desired durability. Typical plastic materials could be Nylon 6/6, Polycarbonate, Acetal, or Polyester.

Figure 11:
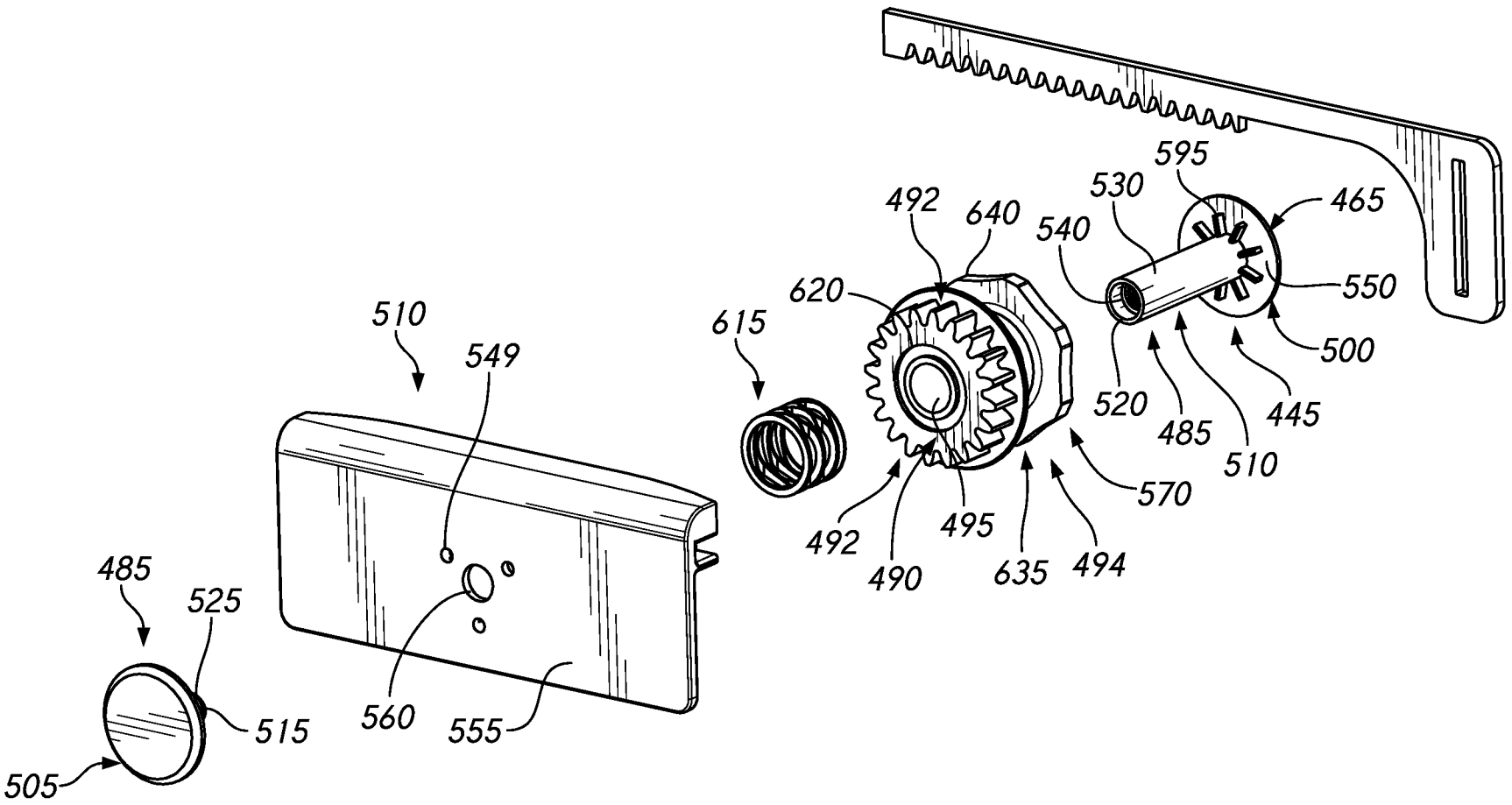
FIG. 11 is an exploded view of the spring of the housing along with the disc and grip of the pinion assembly of FIG. 7.

The lateral outwardly bias of the pedestal 494 along the shaft 485 to a non-rotatable engagement with the inner face 550 of the column end 505 comprises a spring 615 that forcibly contacts an inner face 620 of the pedestal defined at its inner end 492. Referring to FIG. 11, in a preferred embodiment, the spring 615 comprises a circular leaf spring located between the housing 510 and pedestal inner surface 492 about housing's hole 560 and configured for resilient engagement with an inner face 620 of the pedestal defined at its inner end. In other embodiments, however, a common coil spring (not shown) may be utilized in place of the circular leaf spring. In further embodiments, the spring 615 comprises a plurality of forwardly directed tabs (FIGS. 5-6) defined in the housing 510 about housing's hole 560 and configured for resilient engagement with the inner face 620 of the pedestal 494. It is further understood that the spring 615 may comprise a cantilever spring(s) of metal or plastic or an elastomeric foam spring among others.

Referring again to FIGS. 9 and 11, a grip 570 is thus configured to transmit a lateral force "C" to the pedestal 494 to both overcome the bias of the spring 615 and move the pedestal laterally along the shaft 485 of the pinion assembly 435 to the rotatable position "B" from the locked position "A," and also configured to transmit a rotational force "D" to the pedestal to rotate the pedestal (when not in the locked position), to rotate the disc's 490 circular arrangement of teeth 440 of the pedestal 575 against rack 425. More specifically, the lateral force "C" urges the pedestal's inner face 620 against the spring 615 such that the spring is compressed rearwardly against the housing's inner wall 620.

During this movement, the teeth 440 of the pedestal's disc 490 remain engaged with the at least one rack 425, but translate rearwardly in relation to the rack's teeth 430 and towards the housing's inner wall 620. During this rearward movement, the pedestal is translated rearwardly along the column 510 to disengage the pedestal's recesses 600 from the spokes 595 of the outer column end 505. With the spokes and recesses disengaged from one another, the pedestal is rotatable about the column 110 via the application of rotatable force "D" (FIG. 11). Of course, during any rotation of the pedestal 494, the rack 425 will translate in relation to the housing 510, and apply a like translational force against the material of the apparel 20 affixed to the rack's planar flange 460.

To facilitate the transmission of both the lateral and rotational forces "C" and "D" to the pedestal 494, the grip 575 defines a diameter larger than that of the column end 505 such that the outer face 570 of the pedestal and an associated peripheral edge 635 are exposed beyond that of the column end to a facilitate tactile contact with the fingers and thumb of a user of the fastener 5 and to prevent an accidental application of the lateral force "C" via a pressure applied against the column end (i.e., should one wearing the fastener and apparel receive a pressure against the fastener by leaning the waist line of the apparel against a counter, and/or by tightening a belt around the waist line and against the fastener).

In a preferred embodiment, the peripheral edge 635 of the grip 570 is also textured to improve such tactile contact as well. For example, in the embodiments illustrated herein, the peripheral edge 635 of the grip 570 defines a plurality of truncated ridges 640. However other textures may suffice as well, to include cross-hatch, dimpled and other patterns understood in the art of increasing tactile friction. Nonetheless, despite the larger diameter of the grip 570, the diameter is nonetheless configured for insertional engagement with the standard orifice 50 defined in the apparel 20. Thus, the diameter of the grip is between about 0.375 and 2.0 inches, preferably between about 0.5 and 1.5 inches, and optimally about 0.875 inches.

Figure 12:
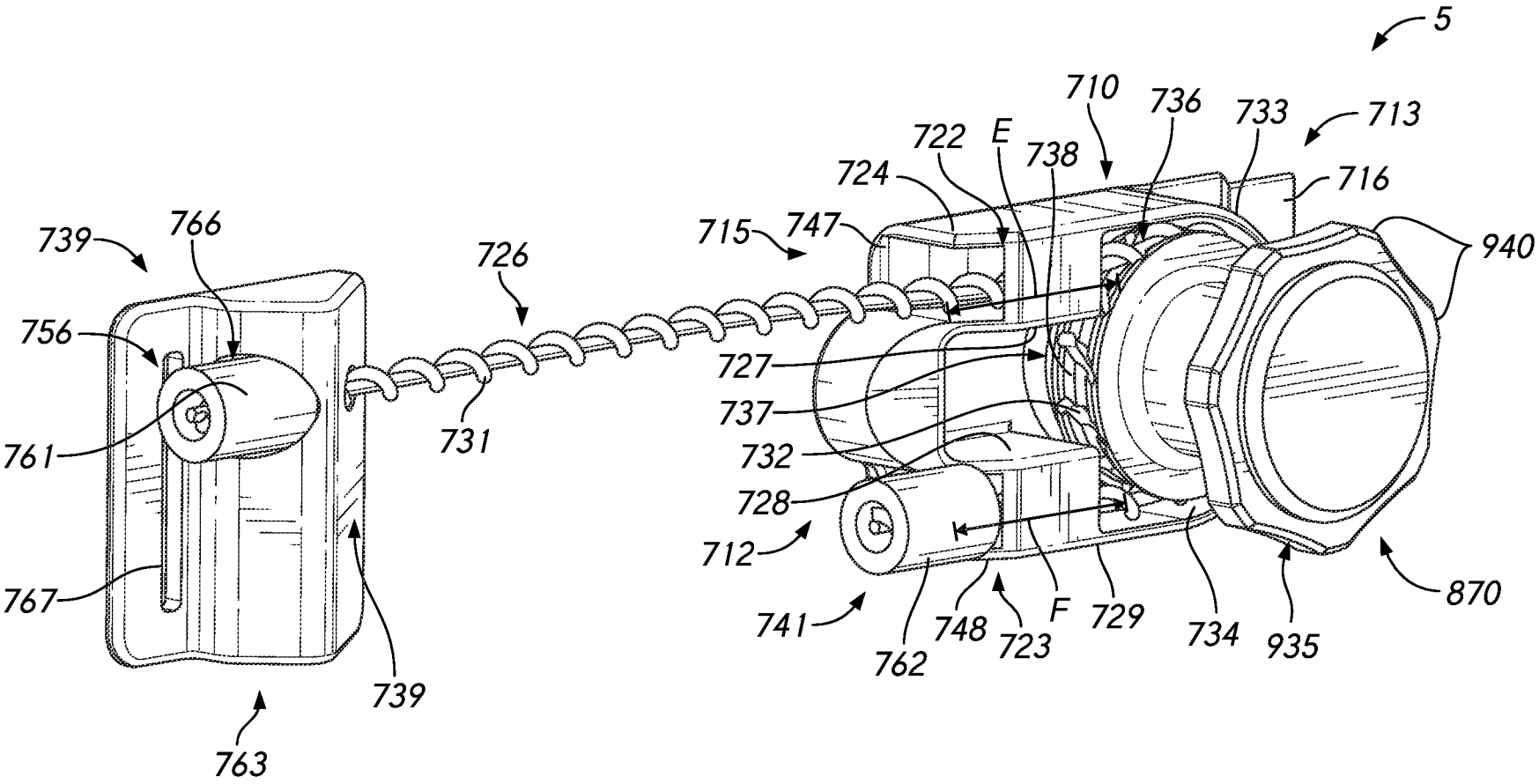
FIG. 12 is a perspective view of a third embodiment of the fastener.
Figure 13:
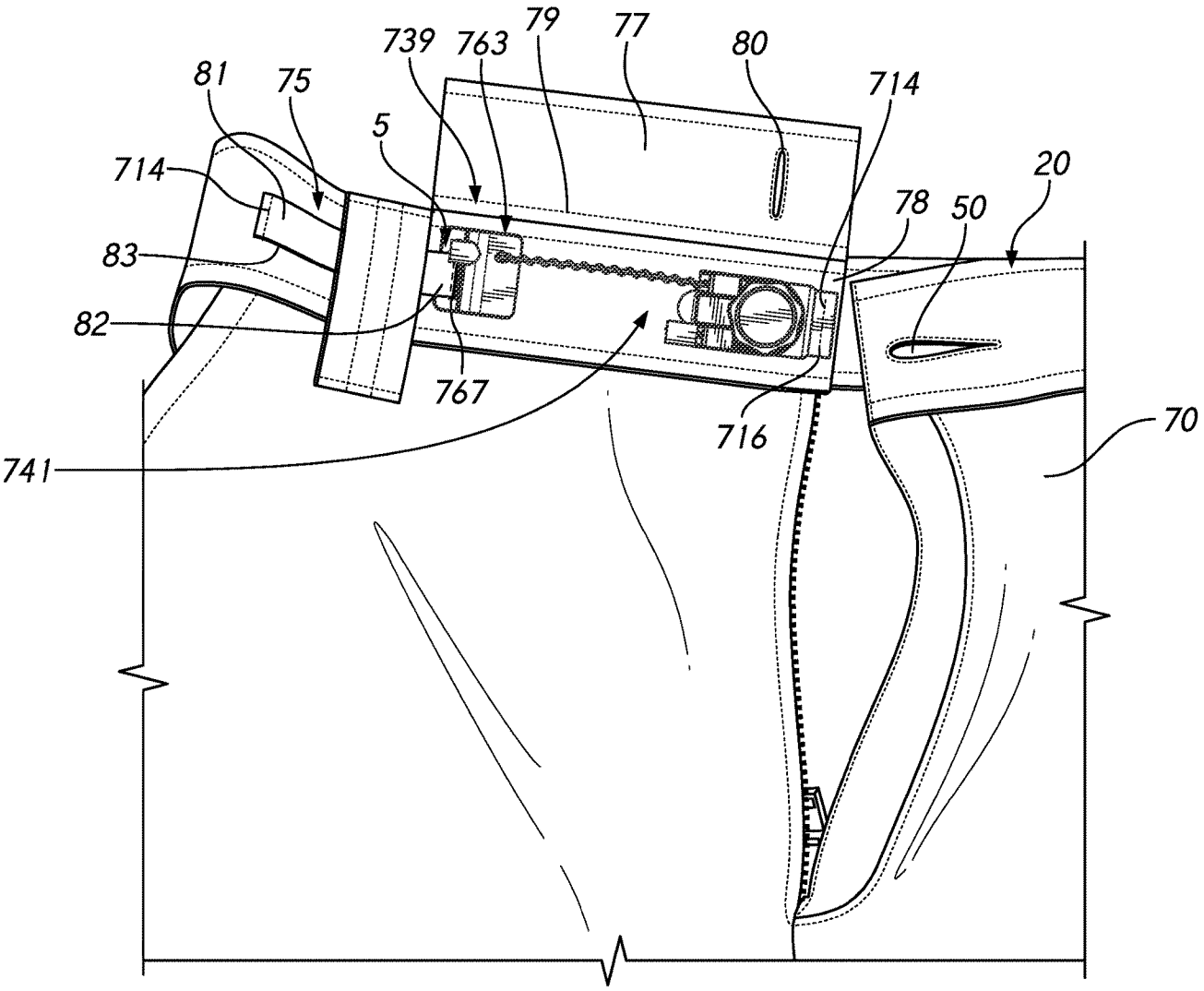
FIG. 13 is a view of the fastener of FIG. 12 utilized with apparel.
Figure 14:
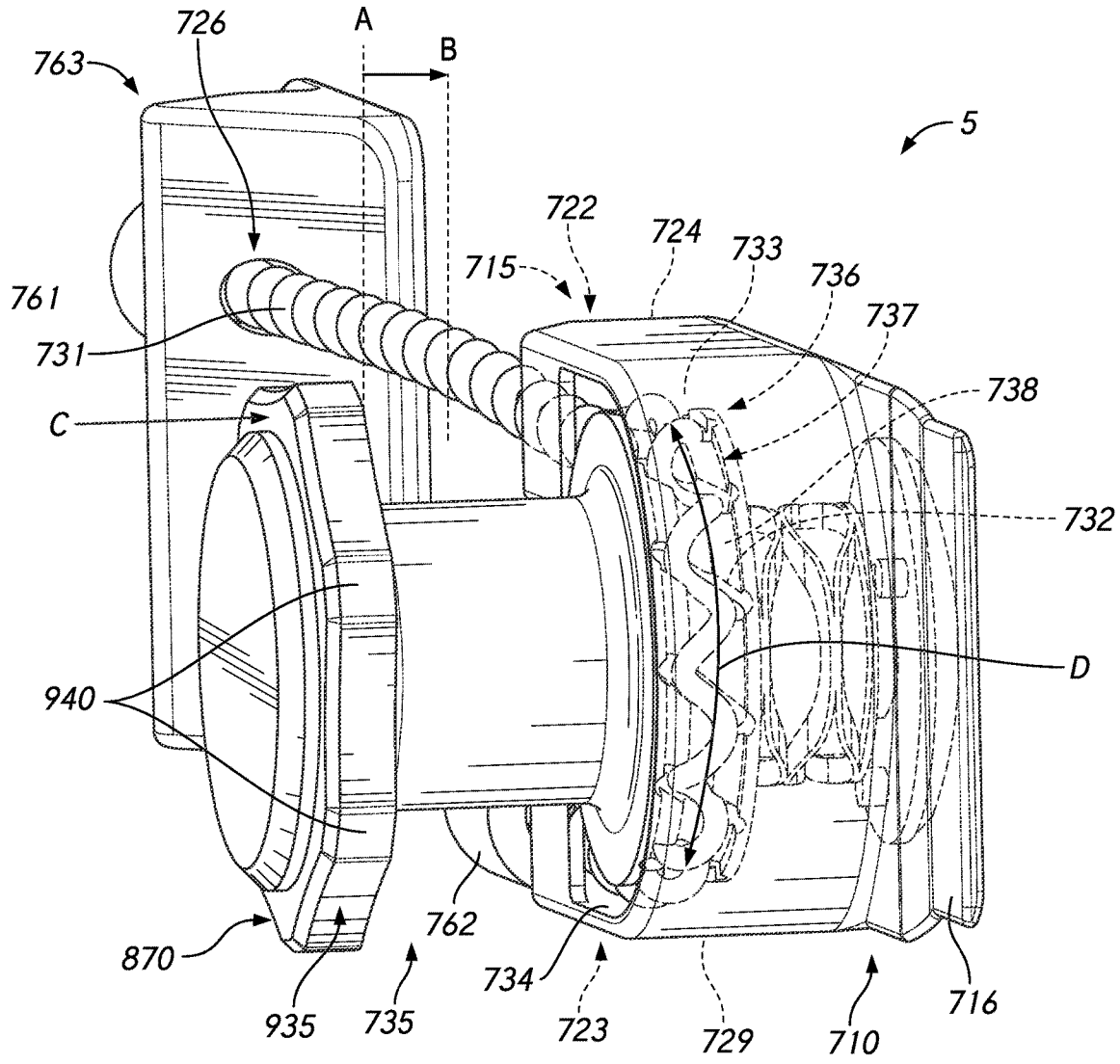
FIG. 14 is an elevation view of a proximal end of the fastener of FIG. 12 with the housing illustrated as transparent to show the components located therein.

In a third embodiment illustrated in FIGS. 12-14 and 18-19, the fastener 5 comprises a housing 710 defining at least one guide-way 715. For the sake of clarity, FIG. 14 illustrates the housing 710 and related components such that the components located therein are visible as "hidden lines." Referring initially to FIG. 12, the housing 710 preferably comprises an approximately lengthwise, rectangular, box-like structure terminating in proximal and distal ends 712 and 713. The housing 710 further defines at least one sheet-like extension 716 to allow for a fixable relation of the fastener 5 with the sheet-form material typically comprising the apparel 20. In the embodiment illustrated herein, the sheet-like extension extends from the distal end 713 of the housing 710, with the fixable relation preferably comprising a stitching 714 (FIG. 13) of the extension to the sheet-form material of the apparel 20 to secure the housing and apparel to one another. However, it is understood that the fixable relation may comprise a riveting of the extension 716 to the apparel 20 as well. In further embodiments, not illustrated herein, the at least one sheet-like extension 716 extends from the proximal end 712 of the housing 710 instead of, or in addition to, that extending from the housing's distal end 713.

At least one flexible tensioning member 726 is directly or indirectly connectible with the apparel 20 and operably associated with the at least one guide-way 715, with the at least one flexible tensioning member defining an epicentric arrangement of male striations 731 along its length between primary and secondary member ends 739 and 741. The flexible tensioning member 726 preferably comprises a "push-pull" cable understood in the art as capable of transmitting both pushing and pulling forces to the primary and secondary member ends 739 and 741. However, it is understood that the flexible tensioning member 726 may comprise other components understood in the art as creating at least tensile (i.e., pulling) forces there-along from the primary end 739, to include belts, chains, ropes, strings and other similar components known in the art. Another option is a product known as a bead chain as is used in opening and closing some window shades or blinds. This element can normally have an operable length allowing a typical 2 inch circumferential reduction in size but it can be seen that the operable length can be lengthened or shortened to implement the desired size change capability.

Figure 18:
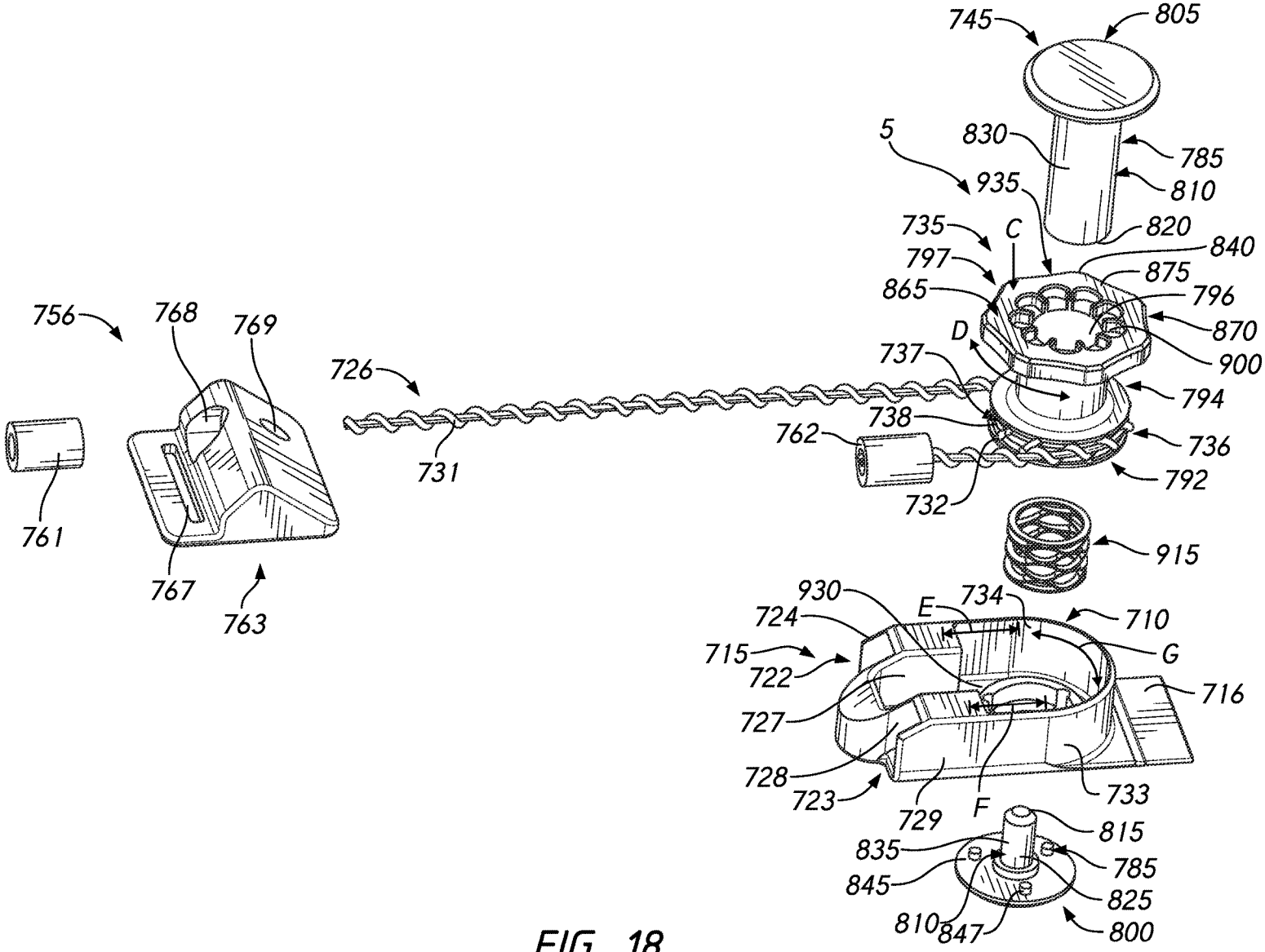
FIG. 18 is an exploded view of the fastener of FIG. 12 illustrating the details of a mating engagement within the pinion assembly.

As best illustrated in FIGS. 12 and 18, the guide-way 715 preferably comprises a pair of through chambers, namely, primary and secondary chambers 722 and 723 having proximal ends 747 and 748 about coterminous with the proximal end 712 of the housing 710. The primary and secondary chambers 722 and 723 define a pair of primary and secondary translation pathways "E" and "F" extending distally from the respective proximal ends 747 and 748 of the primary and secondary chambers 722 and 723 in parallel relation with one another, with the pair of chambers defined by respective upper and lower walls 724 and 727, and 728 and 729. The guide-way further comprises a confinement wall 733 extending distally from the upper and lower walls 724 and 729 of the respective pair of chambers 722 and 723 to define a semi-circular confinement pathway "G" in communication with the pair of translation pathways "E" and "F." The pair of chambers 722 and 723 is configured to accept an insertion of the flexible tensioning member 726 there-through, maintain the member along the respective translation pathways "E" and "F," and guide the member to and from the confinement pathway "G" such that the primary end 739 of the member extends proximally from the primary chamber 722 and the secondary end 741 of the member extends proximally from the secondary chamber 723. The confinement wall 733 maintains the flexible tensioning member 726 along the confinement pathway "G" and within a circular groove 737 defined on a sheave 736 to maintain a synchronism of engagement between the sheave and flexible tensioning member 726.

Figure 19:
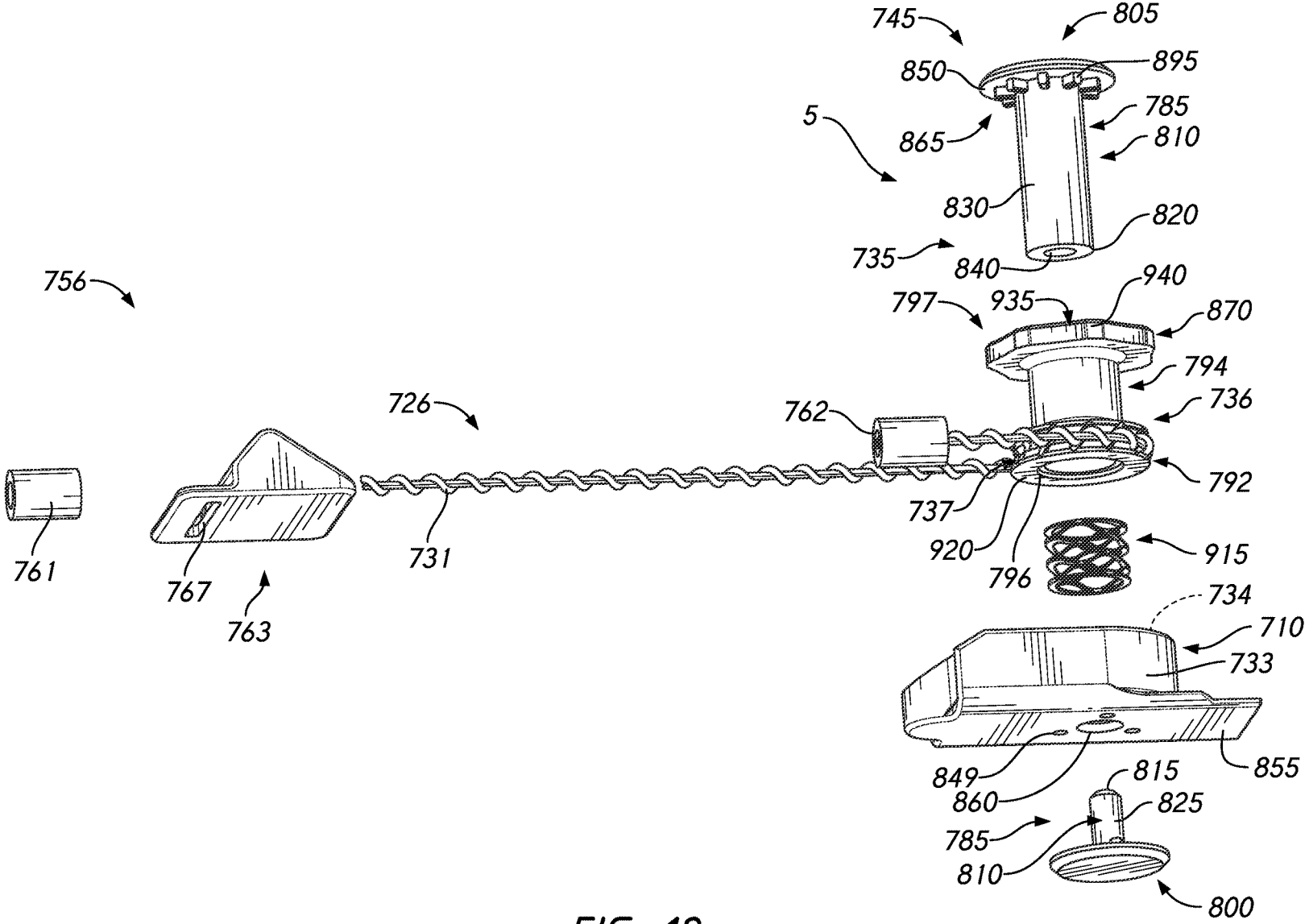
FIG. 19 is an exploded view of the spring of the housing along with the sheave and grip of the pulley assembly of FIG. 12.

Referring to FIGS. 14, 18 and 19, a pinion assembly 735 defines the sheave 736 and associated circular groove 737, with the circular groove defining a peripheral arrangement of female striations 732 configured for meshing engagement with the epicentric arrangement of male striations 731 of the at least one flexible tensioning member 726. The semi-circular confinement wall 733, defining a radial distance between an outer surface 738 of the groove 737 and an inner surface of the wall of about equal to the depth of the female striations 732 within the groove, thus both maintains the flexible tensioning member 726 within the groove of the sheave 736 and ensures that the male striations 731 of the flexible tensioning member remain engaged with the female striations 732 of the sheave. The meshing engagement of the male and female striations 731 and 732 ensures that any rotation of the sheave 736 imparts rotational forces on the flexible tensioning member 726 within the confinement pathway "G" such that the member is translated within the primary and secondary translation pathways "E" and "F" to transmit the pushing and pulling forces through the flexible tensioning member to selectively create and remove a tensile (i.e., pulling) force at its primary end 739.

The sheave 736 and peripheral arrangement of female striations 732 is operably biased to a locked position "A" from a rotatable position "B" (FIG. 14), such that the flexible tensioning member 726 is prevented from translating in relation to the housing 710 when the sheave and peripheral arrangement of female striations is in the locked position, and allowed to translate when the sheave and peripheral arrangement of female striations is in the rotatable position. The pinion assembly 735 further defines an outer end 745 configured for insertional engagement with an orifice 50, also conventionally known as a button hole, (FIG. 13) defined in the apparel 20.

The primary end 739 of the at least one flexible tensioning member 726 is configured for direct or indirect fixable engagement with the material of the apparel 20, with the primary end of the at least one flexible tensioning member 726 defining a primary billet 761. A secondary billet 762 is optionally defined at the secondary end 741 of the flexible tensioning member as well. The primary and optional secondary billets 761 and 762 preferably define respective cylindrical structures to allow for a fixable and operable engagement of the primary end 739 of the flexible tensioning member 726 directly or indirectly with the sheet-form material typically comprising apparel 20 and to allow for a non-interference of the secondary end 741 with the same.

For a direct fixable engagement of the primary billet 761 with the apparel 20, the primary billet secured to the apparel's sheet form material (i.e., with stitching about the flexible tensioning member adjacent to an inner end of the primary billet, not shown). For an indirect fixable engagement of the primary billet 761 with the apparel 20, the primary billet is affixed to a first end 82 the tensioning webbing 81 of the apparel (i.e., again with stitching about the flexible tensioning member adjacent to an inner end of the first billet, not shown), with the second end 83 of the tensioning webbing sewn to the apparel.

In a preferred embodiment of an indirect fixable engagement of the primary billet 761 with the apparel 20, a link 763 (FIG. 12) is utilized to connect the primary billet 761 to the flexible tensioning member 726. In the embodiment illustrated herein, the link 763 is about planar in structure and defines a first void 766 and at least one second void 767 there-though. The first void 766 is configured for an interfering engagement of the link 763 with the primary billet 761 of the flexible tensioning member 726, while the at least one second void 767 is configured for a fixable engagement of the link with the first end 82 of the tensioning webbing 81 (FIG. 13).

Figure 15:
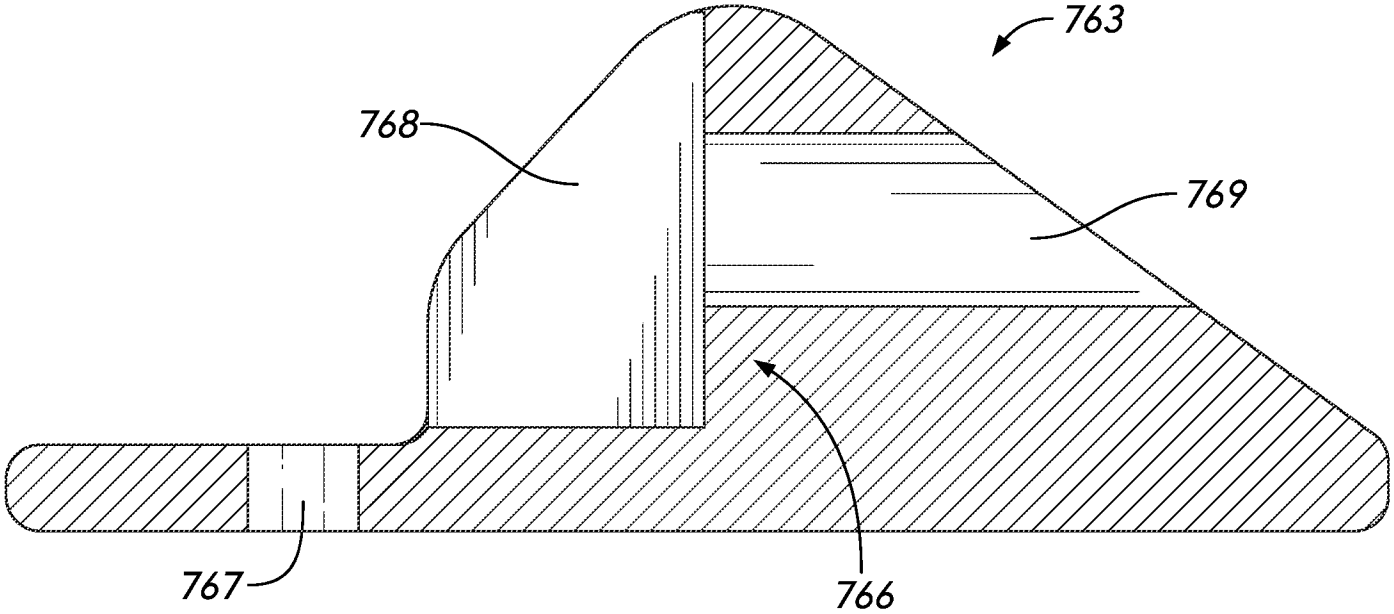
FIG. 15 is a sectional view of a first embodiment of the link.

In a first embodiment of the link 763, illustrated in FIG. 15, which illustrates the link in section, the first void 766 defines a proximal cylindrical socket 768 in communication with a distal through bore 769 of an inner diameter greater than an outer diameter defined by the flexible tensioning member 726, but less than that of an outer diameter defined by the cylindrical structure of the primary billet 761. The cylindrical socket 768 defines an inner diameter greater than the outer diameter of the primary billet 761 such that the billet is movably secured within the socket. The foregoing configuration allows for an insertion of the primary end 756 of the flexible tensioning member 726 into the link's first void 766, with the primary billet 761 movingly secured within the cylindrical socket 768 of the link. The movable securement of the primary billet 761 within the socket 768 allows the billet to rotate within the socket, if necessary, to accommodate any axial rotation of the billet and flexible tensioning member 726 that may occur during operation of the fastener 5. The interfering engagement of the link 763 with the primary billet 761 and flexible tensioning member 726 prevents the link from separating from the flexible tensioning member when at least a tensile (i.e., pulling) force is applied to the primary end 739 of the member by a rotation of the sheave 736.

The at least one second void 767 of the link 763 preferably defines a through rectangular opening such that a portion or flap of the first end 82 (FIG. 13) of the tensioning webbing 81 of the apparel 20 may be inserted through the void and secured to itself via stitching 714. However, a rivet or similar fastener (not shown) may also be inserted through the link's second void 767 and first end 82 of the webbing 81 to securely fasten the link to the webbing 81. In other embodiments, not illustrated herein, the link 763 may be sewn to the first end 82 of the webbing 81 as well.

Figure 16:
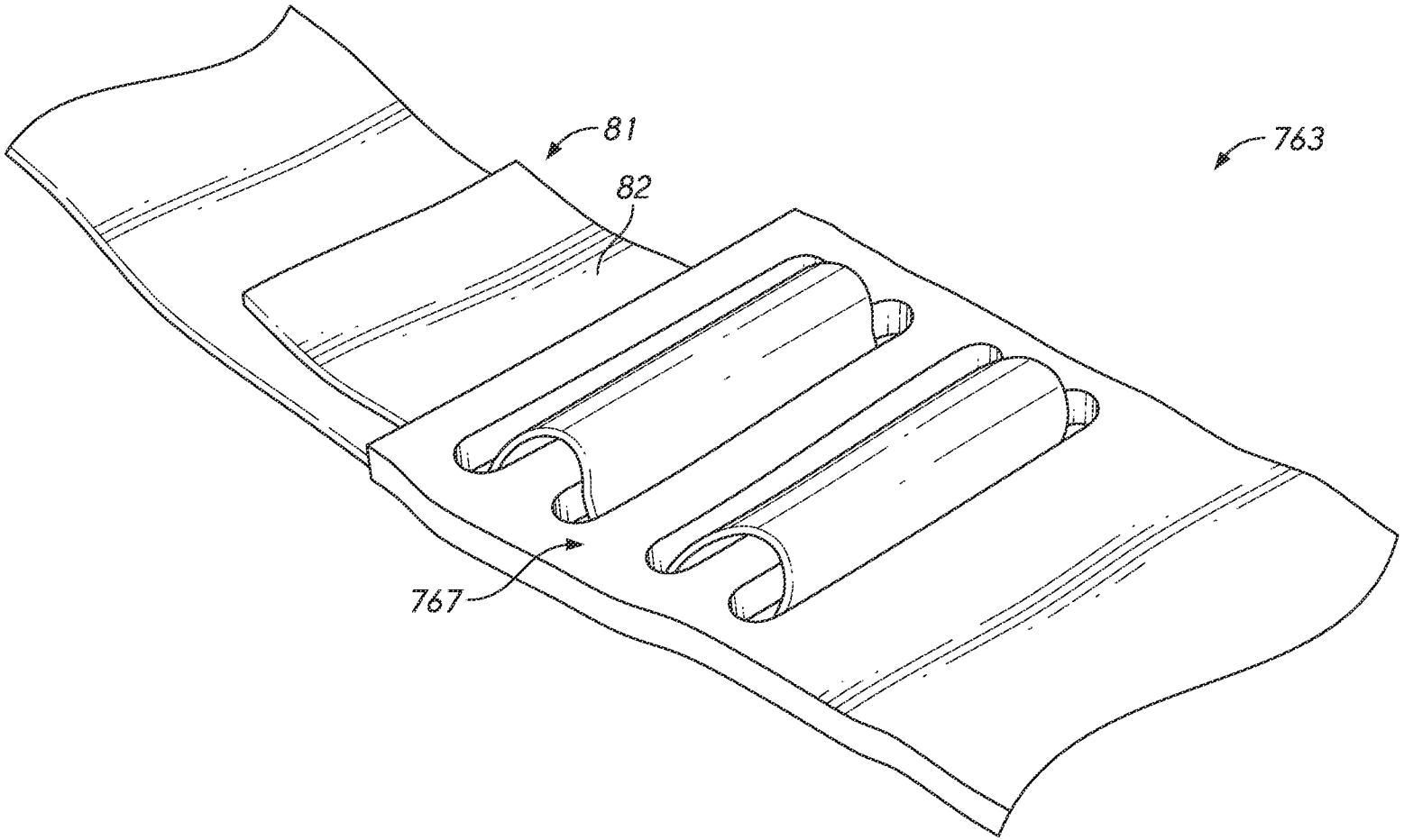
FIG. 16 is a perspective view of a portion of a second embodiment of the link.

In second embodiment of the link 763 illustrated in FIG. 16, the at least one second 767 void comprises two through rectangular openings such that a portion or flap of the first end 82 of the tensioning webbing 81 of the apparel 20 may be inserted through the openings and secured to the link via a frictional contact of the webbing with the link. Because the remaining components of this second link 763 embodiment are identical to that of the first embodiment illustrated in FIG. 15, FIG. 16 illustrates only that portion of the link having the at least one second void 767 defined there-though.

Figure 17:
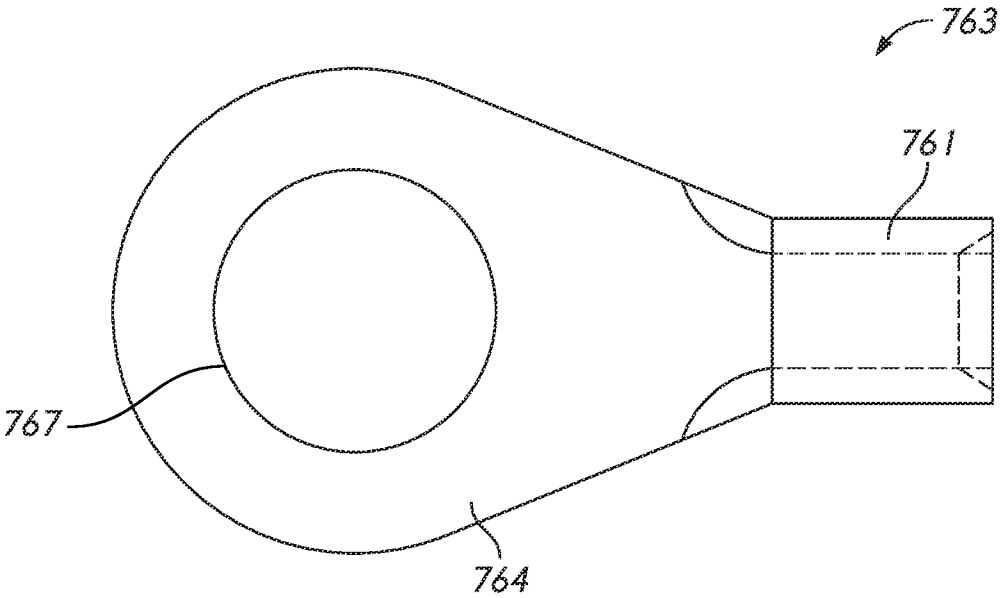
FIG. 17 is a plan view of a third embodiment of the link.

In a third embodiment of the link 763 illustrated in FIG. 17, the primary billet 761 is incorporated into the link such that the billet defines a proximal flange 764 having the at least one second void 767 defined there-through. A rivet or other similar fastener (not shown) may extend through the at least one second void 767 and into the apparel or tensioning webbing to secure them to one another.

As illustrated in FIG. 13, the apparel 20, for example, comprises a pair of pants 70, with the fastener 5 incorporated into the pant's waistline 75 to replace a standard button (not shown). As is typical within the industry, the pants 70 includes a hollow loop of material at its waistline 75 to create at least two "front-to-back" layers 77 and 78 of material encircling the waistline to increase its strength and durability. To more clearly illustrate the placement of the fastener 5 in relation to the pants 70, FIG. 13 illustrates a rectangular section of the front material 77 lifted upwardly and away from the rear material 78 along a seam 79 such that the apparatus is proximal to the rear material and the front material is folded downwardly along the seam to a location proximal to and in front of the apparatus. The fastener's housing 710, at least one guide-way 715, at least flexible tensioning member 726, link 763 and tensioning webbing 81 are together preferably located within the hollow loop of material of the pant's waistline 75, i.e., preferably between the front and back material layers 77 and 78, with the fastener's pinion assembly 735 protruding outwardly through an opening 80, defined through the front layer, to function as the standard button for insertion through the apparel's orifice 50.

In a preferred embodiment, the at least one sheet-like extension 716 of the housing 710 and the second end 83 of the tensioning webbing 81 are sewn to either or both the back and/or front material layers 77 of the apparel 20. The tensioning webbing 81 may define a length between its first and second ends 82 and 83 (within the loop of material of the pant's waistline 75) of any length less than or equal to the waistline's length itself such that the webbing may extend any distance from the link 763 up to the orifice 50 of the pants, with the webbing preferably comprised of non-stretchable material that does not expand along its length while under tension. The webbing 81 material is tensioned between the end of the link 763 and a location along the waistline 75 of the apparel to freely be able to tension between the inner and outer material layers. As the webbing is tensioned, the waistline between the fastener and the anchored second end 83 of the webbing 81 is compressed and buckles or accordions to accommodate the shortening and shrinking of the waistline size. This webbing 81 may essentially extend the full circumference of the pant or be any amount shorter desired.

In many pants and waistlines, elastic textiles are used incorporating elastic threads (Spandex, Lycra) to provide some accommodation of a person's waist dimension. By varying the length of a non-stretch webbing 81 or other fabric strip, the elasticity can be varied. It can also be varied by incorporating sections of elastic materials into the webbing 81 such as a urethane sheet material of various durometers or incorporating elasticity in the webbing material itself.

The fastener's housing 710, at least one guide-way 715, at least flexible tensioning member 726, link 763 and tensioning webbing 81 are together preferably located within the hollow loop of material of the pant's waistline 75, i.e., preferably between the front and back material layers 77 and 78, with the fastener's pinion assembly 735 protruding outwardly through an opening 80, defined through the front layer, to function as the standard button for insertion through the apparel's orifice 50. The fastener's housing 710 may also be anchored to its location to keep the button in the right position when tensioned in any number of ways, i.e., riveted to the inner waistband layer, stitched or tacked at one end or both, or blocked from movement by stitched or bar tacking at the tensioned end or both ends.

In a preferred embodiment, the at least one sheet-like extension 716 of the housing 710 and the second end 83 of the tensioning webbing 81 are sewn with stitching 714 to either or both the back and/or front material layers 77 and/or of the apparel 20. The tensioning webbing 81 may define a length between its first and second ends 82 and 83 (within the loop of material of the pant's waistline 75) of any length less than or equal to the waistline's length itself such that the webbing may extend any distance from the link 763 up to the orifice 50 of the pants, with the webbing preferably comprised of non-stretchable material that does not expand along its length while under tension.

The housing 710 and link 763 are preferably comprised of flexible, lightweight, and corrosion-free materials of high durability. The flexible and lightweight traits of the material allow the components to assume the bodily contours of a wearer of the apparel utilizing the fastener, all while adding negligible weight to the apparel itself. The material of the housing 710 and link 763 may be produced or manufactured to possess a predetermined curvature to further ensure a proper of the apparatus to the contours of a body. The durable and corrosion free traits of the material allows for the regular wear and laundering of the apparel utilizing the fastener without risk of the fastener staining the apparel or otherwise breaking.

As such, the housing 710 and link 763 are preferably comprised of plastic or aluminum. Typical plastic materials could be Nylon 6/6, Polycarbonate, Acetal, or Polyester. The various components of the housing 710 define a wall-thickness of between about 0.039 and 0.393 inches, preferably between about 0.079 and 0.197 inches, and optimally about 0.177 inches. Similarly, the various components of the link 763 define a wall-thickness of between about 0.016 and 0.393 inches, preferably between about 0.023 and 0.197 inches, and optimally about 0.393 inches. The material for the housing 710 and/or link 763 may be made from an injection molded process, via 3-D printing methods, and/or machined or manufactured by other means understood in the art.

Referring to FIGS. 14, 18 and 19, the pinion assembly 735 further defines a shaft 785 affixed to the housing 710 and terminating outwardly of the housing at the pinion assembly's outer end 745. The peripheral arrangement of female striations 732 extends radially into the circular groove 737 of the sheave 736 defined at an inner end 792 of a longitudinal pedestal 794, with the pedestal and sheave having an axial bore 796 defined there-through. The shaft 785 extends through the axial bore 796 of the pedestal 794 and sheave 736, both of which are configured for both rotational and lateral movement about the shaft 785. The pedestal 794 further defines an outer face 875 at an outer end 797 thereof, each of which has the axial bore 796 defined there-through. The pedestal 794 is rotatable about the shaft 785 and laterally biased outwardly such that its outer end 797 non-rotatably engages the outer end 745 of the pinion assembly to define the aforementioned locked position "A."

The shaft 785 comprises opposing column ends 800 and 805 defined opposite of one another to define a central column 810, with each column end approximating the shape of a rivet head. The opposing column ends 800 and 805, in turn, each define inner mating ends 815 and 820, and associated column portions 825 and 830 which, when in mating relation with one another, define the central column 810. The mating ends 815 and 820 thus preferably define respective, male and female press-fit components 835 and 840 that resistively engage one another to define the column 810. Although a press-fit connection is described and illustrated herein at mating ends 815 and 820, it is understood that other connections may be utilized as well, to include pinned male-female connections, threaded and other connections understood in the art as preventing a rotation and translation of components relative to one another.

Referring again to FIGS. 18 and 19, the opposing column ends 800 and 805 each define a planar inner face 845 and 850. Planar inner face 845 is affixed to a planar rear surface 855 of the housing 810 such that column portion 825 extends forwardly through a hole 860 defined through the housing for engagement with opposing column portion 830. Such affixation may comprise spot welding, thermal bonding, press fitting, riveting, brazing, adhesive bonding or other bonding methods understood in the art. The affixation of the inner face 845 of the column end 800 to the rear surface 855 of the housing 810 prevents the column end and associated portion 825 from rotating in relation to the housing and also from translating outwardly from the housing's rear surface 855. The press-fit engagement of the opposing column portion 825 and end mating end 815 to opposing portion 830 thus similarly affixes them as well in relation to the housing 810. At least one pin 847 is defined on the inner face 845 of the inner column end 800 for mating engagement with at least one receiver 849 defined in the housing 810. Thus, if the press-fit engagement of the column portions 825 and 830 affixes them to the housing 810, the engement of the at least one pin 847 with the receiver 849 prevents at least the inner column end 800 from rotating in relation to the housing.

The non-rotatable engagement of the pedestal 794 to the outer end 745 of the pinion assembly 735 preferably comprises a mating obstruction 865 defined there-between. More specifically, as illustrated herein, the pedestal outer face 875 configured for mating engagement with the inner face 850 of column end 805. Referring again to FIGS. 18 and 19, a plurality of radial spokes 895 protrude from the inner face 850 of outer column end 805 for mating engagement with a plurality of radial recesses 900 defined in the pedestal outer face 875. The mating engagement of the spokes 895 with the recesses 900 prevents the pedestal 794 from rotating in relation to the outer end 745 of the pinion assembly 735, but nonetheless allows the pedestal to move laterally and inwardly from the end and along the shaft 785. The components of the pinion assembly 735, together or independently, may be comprised of durable, corrosion-resistant materials, to include aluminum, stainless steel, brass, plastics, combinations or other materials understood in the art as providing the desired corrosion-resistant durability. Typical plastic materials could be Nylon 6/6, Polycarbonate, Acetal, or Polyester.

The lateral outwardly bias of the pedestal 794 along the shaft 785 to a non-rotatable engagement with the inner face 850 of the column end 805 comprises a spring 915 that forcibly contacts an inner face 920 of the pedestal defined at its inner end 792. In a preferred embodiment, the spring 915 comprises a circular leaf spring located between the housing 810 and pedestal inner surface 792 about housing's hole 860 and configured for resilient engagement with an inner face 930 of the pedestal defined at its inner end. In other embodiments, however, a common coil spring (not shown) may be utilized in place of the circular leaf spring. In further embodiments, the spring 915 comprises a plurality of forwardly directed tabs (FIGS. 5-6) defined in the housing 810 about housing's hole 860 and configured for resilient engagement with the inner face 920 of the pedestal 794. It is further understood that the spring 915 may comprise a cantilever spring(s) of metal or plastic or an elastomeric foam spring among others.

Referring again to FIGS. 14 and 18, a grip 870 is thus configured to transmit a lateral force "C" to the pedestal 794 to both overcome the bias of the spring 915 and move the pedestal laterally along the shaft 785 of the pinion assembly 735 to the rotatable position "B" from the locked position "A," and also configured to transmit a rotational force "D" to the pedestal to rotate the pedestal (when not in the locked position), to rotate the sheave's 736 peripheral arrangement of female striations 732 of the pedestal 794 against the flexible tensioning member 726. More specifically, the lateral force "C" urges the pedestal's inner face 920 against the spring 915 such that the spring is compressed rearwardly against the housing's inner wall 930.

During this lateral movement, the arrangement of female striations 732 of the pedestal's sheave 736 remain engaged with the at least one flexible tensioning member 726, but translate rearwardly in relation to the housing and towards the housing's inner wall 930. During this rearward movement, the pedestal is translated rearwardly along the column 810 to disengage the pedestal's recesses 900 from the spokes 895 of the outer column end 805. With the spokes and recesses disengaged from one another, the pedestal is rotatable about the column 810 via the application of rotatable force "D" (FIG. 14). Of course, during any rotation of the pedestal 794, the flexible tensioning member 726, driven circularly along the confinement path "G," will translate in relation to translation path "E" and "F" of the housing 710, and create a translational force along the flexible tensioning member 726 that is transmitted to its primary end 756 and link 763. The link 763 transmits the translational force to the first end 82 of the tensioning webbing 81, with the tensioning webbing's second end 83 being secured to the apparel 20.

As illustrated in FIGS. 12, 13 and 14, when the pedestal 793 is rotated in a clockwise direction, the flexible tensioning member 726 is drawn distally into the primary chamber 722 of the housing 710 such that the member's primary end 739 and the link 763 are both drawn towards the housing and the length of the flexible tensioning member defined between its primary end and the primary chamber is reduced. Because the second end 83 of the tensioning webbing 81 and the housing 710 are each secured to the apparel 20, a drawing of the primary end 739 of the flexible tensioning member 726 towards the housing (with with the associated length reduction of the flexible tensioning member between its primary end and the primary chamber 722) creates a tensile force throughout the tensioning webbing and flexible tensioning member leading up to the sheave 736 distally of the housing's primary chamber.

During this same movement, the flexible tensioning member 726 is expelled proximally out of the secondary chamber 723 of the housing 710 such that the member's secondary end 741 is pushed away from the housing and the length of the flexible tensioning member defined between its secondary end and the secondary chamber is increased to create a "slack" length of the member between its secondary end and the housing. This slack length of the member 726, with the optional secondary billet 762, preferably accumulates proximally of the housing 710 within the hollow loop of material created by the at least two "front-to-back" layers 77 and 78 of material encircling the waistline of the apparel 20.

When the pedestal 793 is rotated in a counter clockwise direction, the flexible tensioning member 726 is expelled proximally from the primary chamber 722 of the housing 710 such that the member's primary end 739 and the link 763 are both pushed away from the housing and the length of the flexible tensioning member defined between its primary end and the primary chamber is increased. Because the second end 83 of the tensioning webbing 81 and the housing 710 are each secured to the apparel 20, a pushing away of the primary end 739 of the flexible tensioning member 726 from the housing (with with the associated length increase of the flexible tensioning member between its primary end and the primary chamber 722) reduces and/or eliminates the tensile force throughout the tensioning webbing and flexible tensioning member leading up to the sheave 736 distally of the housing's primary chamber.

During this same movement, the flexible tensioning member 726 is drawn distally into the secondary chamber 723 of the housing 710 such that the member's secondary end 741 is pulled towards the housing and the length of the flexible tensioning member defined between its secondary end 741 and the secondary chamber is decreased increased to reduce and/or eliminate the "slack" length of the member between its secondary end and the housing. This slack length of the member 726, with the optional secondary billet 762, thus reduces and/or is eliminated proximally of the housing 710 within the hollow loop of material created by the at least two "front-to-back" layers 77 and 78 of material encircling the waistline of the apparel 20. To facilitate the transmission of both the lateral and rotational forces "C" and "D" to the pedestal 794, the grip 870 defines a diameter larger than that of the column end 805 such that the outer face 875 of the pedestal and an associated peripheral edge 935 are exposed beyond that of the column end to a facilitate tactile contact with the fingers and thumb of a user of the fastener 5 and to prevent an accidental application of the lateral force "C" via a pressure applied against the column end (i.e., should one wearing the fastener and apparel receive a pressure against the fastener by leaning the waist line of the apparel against a counter, and/or by tightening a belt around the waist line and against the fastener).

In a preferred embodiment, the peripheral edge 935 (i.e., FIG. 18) of the grip 870 is also textured to improve such tactile contact as well. For example, in the embodiments illustrated herein, the peripheral edge 935 of the grip 870 defines a plurality of truncated ridges 940. However other textures may suffice as well, to include cross-hatch, dimpled and other patterns understood in the art of increasing tactile friction. Nonetheless, despite the larger diameter of the grip 870, the diameter is nonetheless configured for insertional engagement with the standard orifice 50 defined in the apparel 20. Thus, the diameter of the grip is between about 0.375 and 2.0 inches, preferably between about 0.5 and 1.5 inches, and optimally about 0.875 inches.

In use in the first embodiment, a fastener is provided with a piece of apparel worn by an individual, the fastener comprising a housing defining at least one guide-way, at least one rack connectible with the apparel and translationally associated with the at least one guide-way, the rack defining a linear arrangement of teeth and a pinion assembly operably associated with the housing and defining a circular arrangement of teeth configured for operable engagement with the linear arrangement of teeth of the rack, the circular arrangement of teeth operably biased to a locked position from a rotatable position, the pinion assembly further defining an outer end configured for insertional engagement with an orifice defined in the apparel.

The outer end of the pinion assembly of the fastener is inserted through the orifice defined in the apparel. A grip of the pinion assembly is gripped, and a translational force is exerted on the grip to translate the disc to a rotatable position from a biased, non-rotatable position. A rotational force is exerted on the grip to rotate the disc and translate an operably associated rack affixed to the apparel from a locked position. At least the translational force is thereafter removed from the grip, allowing the disc to translate in an opposite direction to the biased, non-rotatable position to secure the rack in the locked position.

In use in the second embodiment, a fastener is provided with a piece of apparel worn by an individual, the fastener comprising a housing defining at least one guide-way, at least one rack connectible with the apparel and translationally associated with the at least one guide-way, the rack defining a linear arrangement of teeth and a pinion assembly operably associated with the housing and defining a circular arrangement of teeth configured for operable engagement with the linear arrangement of teeth of the rack, the circular arrangement of teeth operably biased to a locked position from a rotatable position, the pinion assembly further defining an outer end configured for insertional engagement with an orifice defined in the apparel.

The outer end of the pinion assembly of the fastener is inserted through the orifice defined in the apparel. A grip of the pinion assembly is gripped, and a translational force is exerted on the grip to translate the pedestal to a rotatable position from a biased, non-rotatable position. A rotational force is exerted on the grip to rotate the pedestal and translate an operably associated rack affixed to the apparel from a locked position. At least the translational force is thereafter removed from the grip, allowing the pedestal to translate in an opposite direction to the biased, non-rotatable position to secure the rack in the locked position.

In use in the third embodiment, a fastener is provided with a piece of apparel worn by an individual, the fastener comprising a housing defining at least one guide-way, at least one flexible tensioning member connectible with the apparel and translationally associated with the at least one guide-way, the flexible tensioning member defining an arrangement of epicentric male striations and a pinion assembly operably associated with the housing and defining a peripheral arrangement of female striations configured for operable engagement with the arrangement of male striations of the flexible tensioning member, the peripheral arrangement of female striations operably biased to a locked position from a rotatable position, the pinion assembly further defining an outer end configured for insertional engagement with an orifice defined in the apparel.

The outer end of the pinion assembly of the fastener is inserted through the orifice defined in the apparel. A grip of the pinion assembly is gripped, and a translational force is exerted on the grip to translate the pedestal to a rotatable position from a biased, non-rotatable position. A rotational force is exerted on the grip to rotate the pedestal and translate an operably associated flexible tensioning member affixed to the apparel. At least the translational force is thereafter removed from the grip, allowing the pedestal to translate in an opposite direction to the biased, non-rotatable position to secure the tensioning member in the locked position.

Optionally sequentially, the grip of the pinion assembly is gripped, and a translational force is exerted on the grip to translate the pedestal to a rotatable position from a biased, non-rotatable position. An opposite rotational force is exerted on the grip to rotate the pedestal in an opposite direction and translate an operably associated flexible tensioning member affixed to the apparel in an opposite direction. At least the translational force is thereafter removed from the grip, allowing the pedestal to translate in an opposite direction to the biased, non-rotatable position to secure the tensioning member in the locked position. The outer end of the pinion assembly of the fastener is removed from insertion through the orifice defined in the apparel.

While this foregoing description and accompanying figures are illustrative of the present invention, other variations in structure and method are possible without departing from the invention's spirit and scope.

We claim:

1. A fastener for apparel comprising;

a housing defining at least one guide-way:

at least one flexible tensioning member connectible with the apparel and operably associated with the at least one guide-way, the flexible tensioning member defining an epicentric arrangement of male striations, and a pinion assembly defining a peripheral arrangement of female striations configured for operable engagement with the epicentric arrangement of male striations of the flexible tensioning member the pinion assembly translationally biased to a locked position from a rotatable position, the pinion assembly further defining an outer end configured for insertional engagement with an orifice defined in the apparel, wherein the pinion assembly further defines a shaft affixed to the housing and terminating outwardly of the housing at the outer end of the assembly, said peripheral arrangement of female striations defined within a sheave defined at an inner end of a pedestal and having an axial bore defined there-through, the shaft extending through the axial bore of the pedestal and sheave, the pedestal and sheave rotatable about the shaft and laterally biased to non-rotatably engage the outer end of the assembly to define the locked position.

2. The fastener of claim 1 wherein the non-rotatable engagement of the pedestal and sheave to the outer end comprises a mating obstruction defined there-between and the bias of the pedestal and sheave to the non-rotatable engagement comprises a spring forcibly contacting the sheave.

3. The fastener of claim 2 further comprising a grip defined on the pedestal proximal to the outer end and defining the mating obstruction there-between, the grip configured to transmit a lateral force to the pedestal and sheave to overcome the bias of the spring and also configured to transmit a rotational force to the pedestal and sheave to rotate the pedestal and sheave when not in the locked position, the grip further configured for insertional engagement with the orifice.

4. The fastener of claim 3 wherein the spring is located about the shaft between the pedestal and the housing.

5. The fastener of claim 2 wherein the mating obstruction comprises a plurality of radial spokes protruding from an inner face defined at the outer end and configured for mating engagement with a plurality of radial recesses defined in an outer face of the pedestal.

6. The fastener of claim 1 wherein the flexible tensioning member defines a primary end connectable with the apparel.

7. The fastener of claim 6 further comprising a link operably engaged with the primary end of the flexible tensioning member, the link connectable with the apparel.

8. The fastener of claim 7 further comprising a tensioning webbing defining first and second ends, the first end extending through an orifice defined on the link and the second end connectable with the apparel.

9. The fastener of claim 8 wherein the tensioning webbing is non-stretchable.

10. The fastener of claim 9 wherein the tensioning webbing defined a length that is less than or equal to a length defined by a waistline of the apparel.

11. The fastener of claim 1 wherein the at least one guideway comprises a primary chamber, a secondary chamber and a confinement wall, the primary chamber defining a primary pathway of the tensioning member, the secondary chamber defining a secondary pathway of the member, and the confinement wall defining a confinement pathway of the member, the confinement pathway in communication with the primary and secondary pathways.

12. A method of fastening and tensioning apparel comprising:

providing a fastener with the apparel worn by an individual;

inserting an outer end of a pinion assembly of the fastener through an orifice defined in the apparel;

gripping a grip of the pinion assembly;

exerting a translational force on the grip to translate a pedestal and a sheave to a rotatable position from a biased, non-rotatable position; and exerting a rotational force on the grip to rotate the pedestal and the sheave to impart rotational and translational forces to an operably associated flexible tensioning member to tighten the apparel, the method further comprising providing a link connected to the flexible tensioning member.

13. The method of claim 12 further comprising providing a tensioning webbing connected to the link and affixed to the apparel.

14. The method of claim 12 further comprising removing at least the translational force from the grip; and allowing the pedestal and sheave to translate in an opposite direction to the biased, non-rotatable position to secure the flexible tensioning member in a locked position.

15. The method of claim 14 further comprising:

gripping the grip of the pinion assembly;

exerting the translational force on the grip to translate a pedestal and a sheave to the rotatable position from the biased, non-rotatable position; and exerting an opposite rotational force on the grip to rotate the pedestal and the sheave in an opposite direction to impart opposite rotational and translational forced to the operably associated flexible tensioning member to loosen the apparel.

16. The method of claim 15 further comprising removing at least the translational force from the grip; and allowing the pedestal and sheave to translate in the opposite direction to the biased, non-rotatable position to secure the flexible tensioning member in the locked position; and removing the outer end of the pinion assembly of the fastener from an insertion through the orifice defined in the apparel.

17. The method of claim 16 further comprising providing a link connected to the flexible tensioning member.

18. The method of claim 17 further comprising providing tensioning webbing connected to the link and affixed to the apparel.

* * * * *